US011373600B2

(12) United States Patent
Lee et al.

(10) Patent No.: US 11,373,600 B2
(45) Date of Patent: Jun. 28, 2022

(54) SCAN DRIVING CIRCUIT AND DISPLAY DEVICE INCLUDING THE SAME

(71) Applicant: Samsung Display Co., Ltd., Yongin-Si (KR)

(72) Inventors: Sunhwa Lee, Yongin-si (KR); Gyungsoon Park, Seoul (KR); Heerim Song, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/182,758

(22) Filed: Feb. 23, 2021

(65) Prior Publication Data

US 2021/0407427 A1 Dec. 30, 2021

(30) Foreign Application Priority Data

Jun. 24, 2020 (KR) ..... 10-2020-0077281

(51) Int. Cl.
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 2310/0262* (2013.01); *G09G 2310/0278* (2013.01); *G09G 2310/0289* (2013.01); *G09G 2310/0294* (2013.01)

(58) Field of Classification Search
CPC ..... G09G 3/3266; G09G 3/3225; G09G 2310/0262; G09G 2310/0278; G09G 2310/0289; G09G 2310/0294; G09G 2300/0426; G09G 2300/0814; G09G 2300/0819; G09G 2300/0861; G09G 2300/0866; G09G 2310/0286; G09G 2310/08; G09G 3/3233
See application file for complete search history.

(56) References Cited

U.S. PATENT DOCUMENTS

| | | | |
|---|---|---|---|
| 9,489,882 | B2 | 11/2016 | Kim et al. |
| 10,198,998 | B2 | 2/2019 | In et al. |
| 2016/0217728 | A1* | 7/2016 | In ..... G09G 3/3266 |

FOREIGN PATENT DOCUMENTS

| | | | |
|---|---|---|---|
| KR | 1020160141132 | A | 12/2016 |
| KR | 1020190018932 | A | 2/2019 |
| KR | 101962860 | B1 | 3/2019 |

* cited by examiner

*Primary Examiner* — Mark W Regn
(74) *Attorney, Agent, or Firm* — Cantor Colburn LLP

(57) ABSTRACT

A scan driving circuit includes a driving circuit which outputs a first node signal, a second node signal, and a third scan signal in response to clock signals and a carry signal, a first masking circuit which outputs a first scan signal in response to a first masking signal, the first node signal and the second node signal, and a second masking circuit which discharges the first node signal to a first voltage in response to a second masking signal and the second scan signal.

20 Claims, 14 Drawing Sheets

SCAN DRIVING CIRCUIT AND DISPLAY DEVICE INCLUDING THE SAME

This application claims priority to Korean Patent Application No. 10-2020-0077281, filed on Jun. 24, 2020, and all the benefits accruing therefrom under 35 U.S.C. § 119, the content of which in its entirety is herein incorporated by reference.

BACKGROUND

The present disclosure herein relates to a display device, and more particularly, to a display device including a scan driving circuit.

An organic light emitting display device among display devices displays an image using an organic light emitting diode for emitting light by recombination of electrons and holes. The organic light emitting display has advantages of fast response speed and low power consumption.

The organic light emitting display device is provided with pixels connected to data lines and scan lines. Each of the pixels includes an organic light emitting diode and a circuit unit for controlling a current amount flowing through the organic light emitting diode. The circuit unit controls the current amount flowing from a first driving voltage to a second driving voltage via the organic light emitting diode in response to a data signal. Here, light of a prescribed luminance is generated in response to the current amount flowing through the organic light emitting diode.

A transistor included in the circuit unit is typically formed of a transistor having a low-temperature polycrystalline silicon ("LTPS") semiconductor layer. The LTPS transistor is advantageous in terms of high mobility and stability, but a leakage current is generated when a voltage level of the second driving voltage is lowered or an operation frequency is lowered. When the leakage current is generated in the circuit unit of the pixel, the current amount flowing through the organic light emitting diode changes and thus the display quality may be degraded.

In order to reduce the leakage current of the transistor included in the circuit unit in the pixel, a transistor in which oxide semiconductor is taken as the semiconductor layer is being researched. Furthermore, it is also being studied that an LTPS semiconductor transistor and an oxide semiconductor transistor are used together in the circuit unit of the pixel.

In addition, a technology for reducing the power consumption in a display device is desirable.

SUMMARY

The present disclosure provides a driving circuit capable of reducing the power consumption, and a display device including the same.

An embodiment of the inventive concept provides a scan driving circuit including: a driving circuit which outputs a first node signal, a second node signal, and a third scan signal in response to clock signals and a carry signal; a first masking circuit which outputs a first scan signal in response to a first masking signal, the first node signal and the second node signal; and a second masking circuit which discharges the first node signal to a first voltage in response to a second masking signal and the second scan signal.

In an embodiment, the driving circuit may include: a first transistor which delivers the carry signal as the first node signal in response to a first clock signal among the clock signals; and a second transistor which delivers a second voltage as the second scan signal in response to a signal at the first node.

In an embodiment, the scan driving circuit may further include: a first output terminal connected to a first scan line and which outputs the first scan signal; and a second output terminal connected to a second scan line and which outputs the second scan signal.

In an embodiment, the first masking circuit may include: a first masking transistor connected between a second voltage terminal which receives the second voltage and a first masking node, and including a gate electrode which receives the second node signal; a second masking transistor connected between the first masking node and the first output terminal, and including a gate electrode which receives the first masking signal; and a third masking transistor connected between the first output terminal and a first voltage terminal which receives the first voltage, and including a gate electrode which receives the first node signal.

In an embodiment, the driving circuit may output a third node signal to a third node in response to the clock signals, the carry signal, and the first node signal, and the first masking circuit may further include a fourth masking transistor and a fifth masking transistor serially connected between the first output terminal and the first voltage terminal, wherein the fourth masking transistor may include a gate electrode connected to the third node, and the fifth masking transistor may include a gate electrode connected to the first output terminal.

In an embodiment, the second masking circuit may include: a first masking transistor connected between the first transistor and a second masking node, and including a control electrode which receives the second masking signal; and a second masking transistor connected between the second masking node and the first voltage terminal which receives the first voltage, and including a gate electrode connected to the second output terminal.

In an embodiment, the first masking circuit may further receive a third masking signal.

In an embodiment, the first masking circuit may include: a first masking transistor connected between a second voltage terminal which receives the second voltage and a first masking node, and including a gate electrode which receives the third masking signal; a second masking transistor connected between a second node which delivers the second node signal and the first masking node, and including a control electrode which receives the first masking signal; a third masking transistor connected between the second voltage terminal and the first output terminal, and including a gate electrode connected to the first masking node; and a fourth masking transistor connected between the first output terminal and a first voltage terminal which receives the first voltage, and including a gate electrode which receives the first node signal.

In an embodiment, the third masking signal may be complementary with the first masking signal.

In an embodiment, the driving circuit may output a third node signal to a third node in response to the clock signals, the carry signal, and the first node signal, and the first masking circuit may further include a fourth masking transistor and a fifth masking transistor serially connected between the first output terminal and the first voltage terminal, wherein the fourth masking transistor may include a gate electrode connected to the third node, and the fifth masking transistor may include a gate electrode connected to the first output terminal.

In an embodiment of the inventive concept, a display device includes: a display panel including a plurality of pixels connected with a plurality of data lines, a plurality of first scan lines and a plurality of second scan lines, respectively, where the display panel divides the display panel into a first display area and a second display area; a data driving circuit which drives the plurality of data lines; a scan driving circuit which drives the plurality of scan lines; and a driving controller which receives an image signal and a control signal, and controls the data driving circuit and the scan driving circuit such that an image corresponding to the image signal is displayed on the display panel. The driving controller outputs a first masking signal and a second masking signal which indicate a start point of the second display area, and the scan driving circuit includes a plurality of driving stages which respectively output first scan signals to corresponding first scan lines among the first scan lines, and second scan signals to corresponding second scan lines among the second scan lines. Each of the plurality of driving stages includes: a driving circuit which outputs a first node signal, a second node signal, and a second scan signal in response to clock signals and a carry signal; a first masking circuit which outputs a first scan signal in response to the first masking signal, the first node signal and the second node signal; and a second masking circuit which discharges the first node signal to a first voltage in response to the second masking signal and the second scan signal.

In an embodiment, in response to the first masking signal and the second masking signal, the scan driving circuit may drive first scan lines and second scan lines corresponding to the first display area among the plurality of first scan lines and the plurality of second scan lines at a first driving frequency, and drive first scan lines and second scan lines corresponding to the second display area among the plurality of first scan lines and the plurality of second scan lines at a second driving frequency, and the second driving frequency is lower than the first driving frequency.

In an embodiment, the second scan signal output from a j-th driving stage among the plurality of driving stages may be provided as the carry signal of a (j+1)-th driving stage, where j is a natural number.

In an embodiment, the driving circuit may include: a first transistor which delivers the carry signal as the first node signal in response to a first clock signal among the clock signals; and a second transistor which delivers a second voltage as the second scan signal in response to a signal at the first node.

In an embodiment, the each of the plurality of driving stages may further include: a first output terminal connected to the first scan line and which outputs the first scan signal; and a second output terminal connected to the second scan line and which outputs the second scan signal.

In an embodiment, the first masking circuit may include: a first masking transistor connected between a second voltage terminal which receives the second voltage and a first masking node, and including a gate electrode which receives the second node signal; a second masking transistor connected between the first masking node and the first output terminal, and including a gate electrode which receives the first masking signal; and a third masking transistor connected between the first output terminal and a first voltage terminal which receives the first voltage, and including a gate electrode which receives the first node signal.

In an embodiment, the driving circuit may output a third node signal to a third node in response to the clock signals, the carry signal, and the first node signal, and the first masking circuit may further include a fourth masking transistor and a fifth masking transistor serially connected between the first output terminal and the first voltage terminal, wherein the fourth masking transistor may include a gate electrode connected to the third node, and the fifth masking transistor may include a gate electrode connected to the first output terminal.

In an embodiment, the second masking circuit may include: a first masking transistor connected between the first transistor and the second masking node, and including a control electrode which receives the second masking signal; and a second masking transistor connected between the second masking node and a first voltage terminal which receives the first voltage, and including a gate electrode connected to the second output terminal.

In an embodiment, the first masking circuit may include: a first masking transistor connected between a second voltage terminal which receives the second voltage and a first masking node, and including a gate electrode which receives a third masking signal; a second masking transistor connected between a second node which delivers the second node signal and the first masking node, and including a control electrode which receives the first masking signal; a third masking transistor connected between the second voltage terminal and the first output terminal, and including a gate electrode connected to the first masking node; and a fourth masking transistor connected between the first output terminal and a first voltage terminal which receives the first voltage, and including a gate electrode which receives a signal at the first node.

In an embodiment, the driving circuit may output a third node signal to a third node in response to the clock signals, the carry signal, and the first node signal, and the first masking circuit may further include a fourth masking transistor and a fifth masking transistor serially connected between the first output terminal and the first voltage terminal, wherein the fourth masking transistor may include a gate electrode connected to the third node, and the fifth masking transistor may include a gate electrode connected to the first output terminal.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

Figure 1:
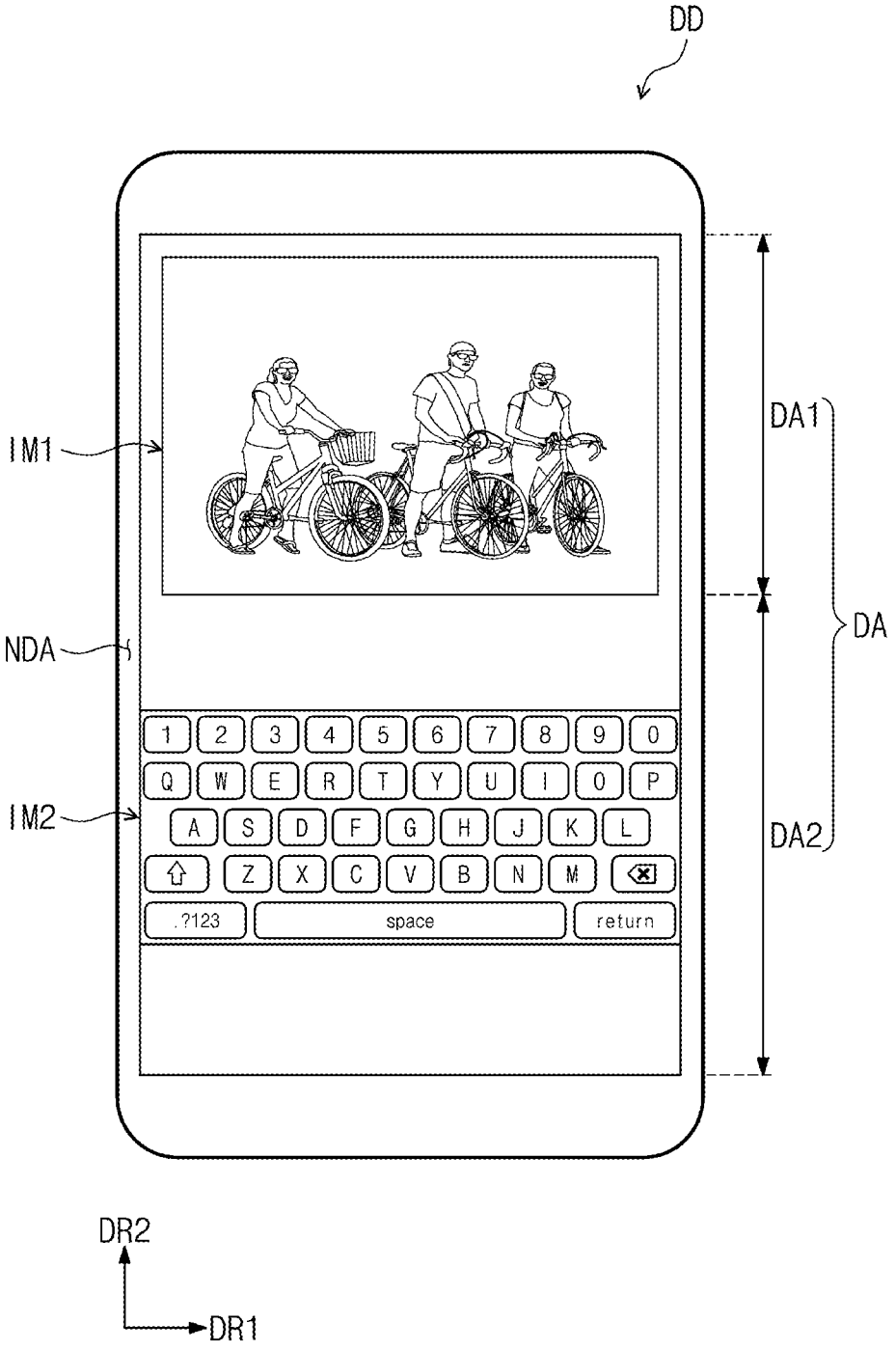
FIG. 1 shows a display device according to an embodiment of the inventive concept.

It will be understood that when an element or layer is referred to as being "on", "to" or "coupled to" another element or layer, it can be directly on, connected or coupled to the other element or intervening third elements may be present. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Like reference numerals in the drawings refer to like elements. In addition, in the drawings, the thickness and the ratio and the dimension of the element are exaggerated for effective description of the technical contents. The term "and/or" includes any and all combinations of one or more of the associated items.

Terms such as first, second, and the like may be used to describe various components, but these components should not be limited by the terms. These terms are only used to distinguish one element from another. For instance, a first component may be referred to as a second component, or similarly, a second component may be referred to as a first component, without departing from the scope of the present disclosure. As used herein, the singular forms "a," "an," and "the" may be intended to include the plural forms as well, unless the context clearly indicates otherwise.

In addition, the terms such as "under", "lower", "on", and "upper" are used for explaining associations of items illustrated in the drawings. It will be understood that the spatially relative terms are intended to encompass different orientations of the device in use or operation in addition to the orientation depicted in the figures.

It will be further understood that the terms "includes" and/or "including", when used in this specification, specify the presence of stated features, integers, steps, operations, elements, components or combinations thereof, but do not preclude the presence or addition of one or more other features, integers, steps, operations, elements, components, or combinations thereof.

Unless otherwise defined, all terms (including technical and scientific terms) used herein have the same meaning as commonly understood by one of ordinary skill in the art to which example embodiments belong. In addition, it will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Hereinafter, embodiments of the inventive concept will be described with reference to the accompanying drawings.

FIG. 1 shows a display device according to an embodiment of the inventive concept.

Referring to FIG. 1, a mobile terminal is illustrated as an example of a display device DD according to an embodiment of the inventive concept. The mobile terminal may include a tablet PC, a smartphone, a personal digital assistant ("PDA"), a portable multimedia player ("PMP"), a game machine, a wristwatch type electronic apparatus, or the like. However, the embodiment of the present inventive concept is not limited thereto. The inventive concept may be used not only in large-sized electronic equipment such as a television set or an outdoor billboard, but also in medium or small-sized electronic equipment such as a personal computer, a notebook computer, a kiosk, a vehicle navigation unit, or a camera. These are only enumerated as embodiments, and the display device DD may also be employed to other electronic devices without being deviated from the inventive concept.

As shown in FIG. 1, a display surface on which a first image IM1 and a second image IM2 are displayed is parallel to a surface defined by a first direction DR1 and a second direction DR2. The display device DD includes a plurality of areas divided on the display surface. The display surface includes a display area DA in which the first image IM1 and the second image IM2 are displayed, and a non-display area NDA adjacent to the display area DA. The non-display area NDA may be called as a bezel area. In one embodiment, for example, the display area DA may be a quadrangular shape. The non-display area NDA may surround the display area DA. In addition, although not shown in the drawing, the display DD may partially include, for example, a curved shape. As a result, one area of the display area DA may have the curved shape.

The display area DA of the display device DD includes a first display area DA1 and a second display area DA2. In a specific application program, the first image IM1 may be displayed in the first display area DA1, and the second image IM2 may be displayed on the second area DA2. In one embodiment, for example, the first image IM1 may be a moving image, and the second image IM2 may be a still image or text information which does not change for a long period.

The display device DD according to an embodiment may drive the first display area DA1 in which a moving image is displayed at a normal frequency (e.g., 120 Hertz (Hz)), and drive the second display area DA2 at a low frequency (e.g., 1 Hz) lower than the normal frequency. The display device DD may reduce consumption power by lowering the driving frequency of the second display area DA2.

Each size of the first display area DA1 and the second display area DA2 may be preset and changed by an application program. In an embodiment, when a still image is displayed in the first display area DA1 and a moving image is displayed in the second display area DA2, the first display area DA1 may be driven at the low frequency (e.g., 1 Hz), and the second display area DA2 may be driven at the normal frequency (e.g., 120 Hertz). In addition, the display area DA may be divided into three or more display areas, and the driving frequency of each of the display areas may be determined according to an image type (e.g., whether a still image or a moving image) to be displayed in each of the display areas.

Figure 2:
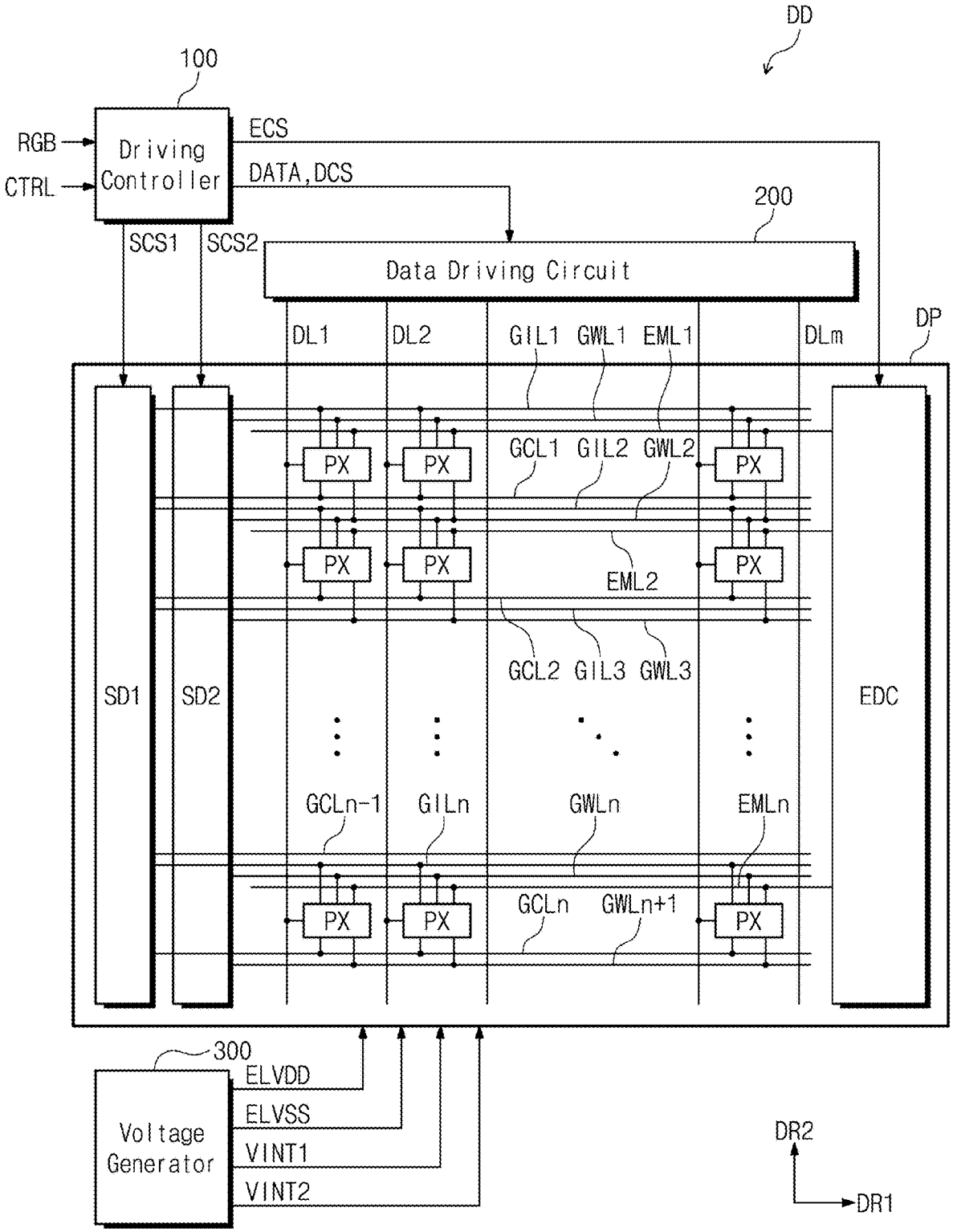
FIG. 2 is a block diagram of a display device according to an embodiment of the inventive concept.

FIG. 2 is a block diagram of a display device according to an embodiment of the inventive concept.

Referring to FIG. 2, the display device DD includes a display panel DP, a driving controller 100, a data driving circuit 200, and a voltage generator 300.

The driving controller 100 receives an image signal RGB and a control signal CTRL. The driving controller 100 generates an image data signal DATA by converting a data format of the image signal RGB so as to satisfy the specification of an interface with the data driving circuit 200. The driving controller 100 outputs a first scan control signal SCS1, a second scan control signal SCS2, a data control signal DCS, and a light emission control signal ECS.

The data driving circuit 200 receives the data control signal DCS and the image data signal DATA from the driving controller 100. The data driving circuit 200 converts the image data signal DATA into data signals, and outputs the data signals to a plurality of data lines DL1 to DLm (to be described later). The data signals are analog voltages corresponding to grayscale values of the image data signal DATA.

The voltage generator 300 generates voltages for operations of the display panel DP. In this embodiment, the voltage generator 300 may generate a first driving voltage ELVDD, a second driving voltage ELVSS, a first initialization voltage VINT1, and a second initialization voltage VINT2.

The display panel DP may include first scan lines GIL1 to GILn, second scan lines GCL1 to GCLn, third scan lines GWL1 to GWLn+1, light emission control lines EML1 to EMLn, data lines DL1 to DLm, and pixels PX. Here, m and n are natural numbers. The display panel DP may further include a first scan driving circuit SD1, a second scan driving circuit SD2, and a light emission driving circuit EDC. In an embodiment, the first scan driving circuit SD1 and the second scan driving circuit SD2 may be arranged in a first side of the display panel DP, and the light emission driving circuit EDC may be arranged in a second side of the display panel DP. In other words, the first scan driving circuit SD1 and the second scan driving circuit SD2 may be arranged to face the light emission driving circuit EDC with the pixels PX therebetween in the first direction DR1.

The first scan lines GIL1 to GILn and the second scan lines GCL1 to GCLn extend in the first direction DR1 from the first scan driving circuit SD1. The third scan lines GWL1 to GWLn+1 extend in the first direction DR1 from the second scan driving circuit SD2. The light emission control lines EML1 to EMLn extend in the opposite direction (i.e., a direction from right side to left side in FIG. 2) to the first direction DR1 from the light emission driving circuit EDC.

The first scan lines GIL1 to GILn, the second scan lines GCL1 to GCLn, the third scan lines GWL1 to GWLn+1, and the light emission control lines EML1 to EMLn are arranged in the second direction DR2 to be spaced apart from each other. The data lines DL1 to DLm extend from the data driving circuit 200 in the opposite direction (i.e., a direction from right side to left side in FIG. 2) to the second direction DR2, and are arranged in the first direction DR1 to be spaced apart from each other.

Each of the plurality of pixels PX is electrically connected to a corresponding one among the first scan lines GIL1 to GILn, a corresponding one among the second scan lines GCL1 to GCLn, corresponding two among the third scan lines GWL1 to GWLn+1, and a corresponding one among the light emission control lines EML1 to EMLn. That is, each of the plurality of pixels PX may be electrically connected to four scan lines. In one embodiment, for example, as shown in FIG. 2, pixels in a first row may be connected to the scan lines GILL GCL1, GWL1, and GWL2. In addition, the pixels in a second row may be connected to the scan lines GIL2, GCL2, GWL2, and GWL3. The pixels in an n-th row may be connected to the scan lines GILn, GCLn, GWLn, and GWLn+1.

Each of the plurality of pixels PX may include an organic light emitting diode ED (see FIG. 3), and a pixel circuit unit PXC (see FIG. 3) for controlling the light emission of the light emitting diode ED. The pixel circuit unit PXC may include a plurality of transistors and a capacitor. At least one of the first scan driving circuit SD1, the second scan driving circuit SD2, and the light emission driving circuit EDC may include transistors provided through the same process as that of the pixel circuit unit.

Each of the plurality of pixels PX receives the first driving voltage ELVDD, the second driving voltage ELVSS, the first initialization voltage VINT1, and the second initialization voltage VINT2.

The first scan driving circuit SD1 receives a first scan control signal SCS1 from the driving controller 100. In response to the first scan control signal SCS1, the first scan driving circuit SD1 may output first scan signals to the first scan lines GIL1 to GILn, and second scan signals to the second scan lines GCL1 and GCLn.

The second scan driving circuit SD2 receives a second scan control signal SCS2 from the driving controller 100. In response to the second scan control signal SCS2, the second scan driving circuit SD2 may output third scan signals to the third scan lines GWL1 to GWLn+1.

The circuit configuration and operation of the first scan driving circuit SD1 will be described later in detail.

The light emission driving circuit EDC receives a light emission control signal ECS from the driving controller 100. In response to the light emission control signal ECD, the light emission driving circuit EDC may output the light emission control signals to the light emission control lines EML1 to EMLn.

In FIG. 2, the first scan driving circuit SD1 and the second scan driving circuit SD2 are illustrated as arranged only in the first side of the display panel DP, but the embodiment of the inventive concept is not limited thereto. In another embodiment, one of the first scan driving circuit SD1 and the second scan driving circuit SD2 may be disposed in the first side of the display panel DP and the other may be disposed in the second side of the display panel DP.

The driving controller 100 according to an embodiment divides the display panel DP into the first display area DA1 (see FIG. 1) and the second display area DA2 (see FIG. 1) on the basis of the control signal CTRL and/or the image signal RGB, and outputs at least one masking signal for indicating the start point of the second display area DA2. The at least one masking signal may be included in each of the first scan control signal SCS1 and the second scan control signal SCS2.

In response to the first scan control signal SCS1, the first scan driving circuit SD1 according to an embodiment may drive first and second scan lines, which correspond to the first display area DA1, among the first scan lines GIL1 to GILn and the second scan lines GCL1 to GCLn at a first driving frequency, and drive first and second scan lines, which correspond to the second display area DA2, at a second driving frequency different from the first driving frequency.

Similarly, in response to the second scan control signal SCS2, the second scan driving circuit SD2 may drive third scan lines, which correspond to the first display area DA1, among the third scan lines GWL1 to GWLn+1 at the first driving frequency, and drive third scan lines, which correspond to the second display area DA2, at the second driving frequency different from the first driving frequency.

Figure 3:
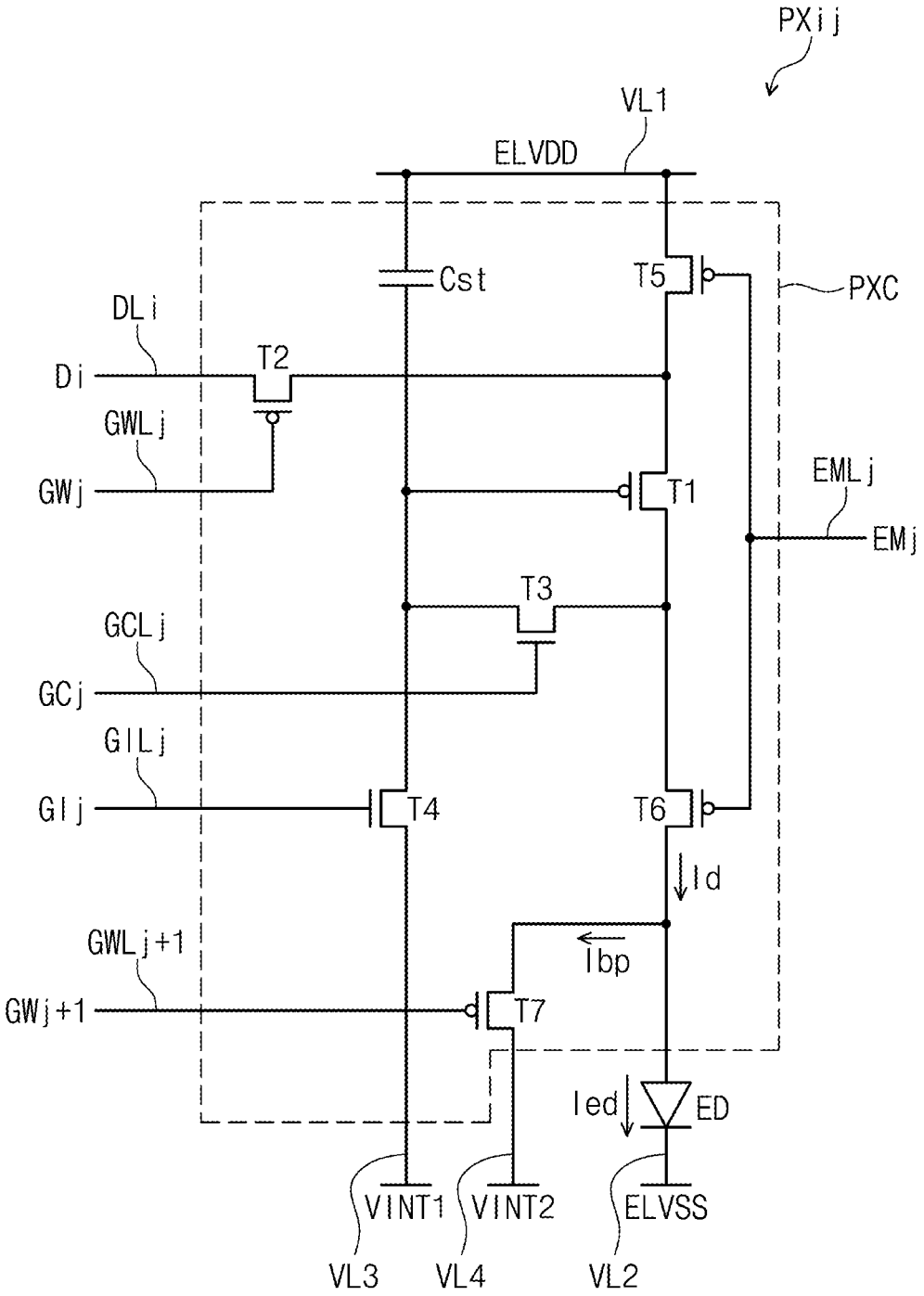
FIG. 3 is an equivalent circuit diagram of a pixel according to an embodiment of the inventive concept.

FIG. 3 is an equivalent circuit diagram of a pixel according to an embodiment of the inventive concept.

FIG. 3 illustrates an exemplary equivalent circuit diagram of a pixel PXij connected to an i-th data line DLi among the data lines DL1 to DLM shown in FIG. 1, a j-th first scan line GILj among the first scan lines GIL1 to GILn, a j-th second scan line GCLj among the second scan lines GCL1 to GCLn, a j-th third scan line GWLj and a(j+1)-th third scan line GWLj+1 among the third scan lines GWL1 to GWLn+1, and a j-th light emission control line EMLj among the light emission control lines EML1 to EMLn. Here i is a natural number equal to or less than m, and j is a natural number equal to or less than n.

Each of the plurality of pixels PX shown in FIG. 2 may have the same circuit configuration as the equivalent circuit diagram of the pixel PXij shown in FIG. 3. In the embodiment, the pixel circuit unit PXC of the pixel PXij may include first to seventh transistors T1 to T7 and one capacitor Cst. In addition, each of the first, the second, the fifth, the sixth and the seventh transistors T1, T2, T5, T6 and T7 may be a P-type transistor having an LTPS semiconductor layer, and each of the third and fourth transistors T3 and T4 may be an N-type transistor having oxide semiconductor as a semiconductor layer. However, the embodiment of the inventive concept is not limited thereto, and at least one of the first to seventh transistors T1 to T7 may be an N-type transistor and the rest may be P-type transistors in another embodiment. In addition, the circuit configuration of the pixel according to an embodiment of the inventive concept is not limited to FIG. 2. The pixel circuit unit PXC illustrated in FIG. 3 is merely exemplary, and the configuration of the pixel circuit unit PXC may be modified and practiced.

With reference to FIG. 3, the pixel PXij of the display device DD according to an embodiment includes the first to seventh transistors T1, T2, T3, T4, T5, T6 and T7, the capacitor Cst, and at least one light emitting diode ED. This embodiment describes an example in which one pixel PXij includes one light emitting diode ED.

For convenience of description, hereinafter, the j-th first scan line GILj, the j-th second scan line GCLj, the j-th third scan line GWLj, the (j+1)-th third scan line GWLj+1, and the j-th light emission control line EMLj will be referred to as a first scan line GILj, a second scan line GCLj, a third scan line GWLj, a fourth scan line GWLj+1, and a light emission control line EMLj, respectively.

The first to fourth scan lines GILj, GCLj, GWLj and GWLj+1 may deliver the first to fourth scan signals GIj, GCj, GWj and GWj+1, respectively. The first scan signal GIj may turn on/off the fourth transistor T4 that is an N-type transistor. The second scan signal GCj may turn on/off the third transistor T3, which is an N-type transistor. The third scan signal GWj may turn on/off the second transistor T2, which is a P-type transistor. The fourth scan signal GWj+1 may turn on/off the seventh transistor T7, which is a P-type transistor.

The light emission control line EMLj may deliver an emission control signal EMj that may control emission of the light emitting diode ED included in the pixel PXij. The emission control signal EMj delivered by the light emission control line EMLj may have a different waveform from the scan signals GIj, GCj, GWj, and GWj+1 that are delivered by the first to fourth scan lines GILj, GCLj, GWLj, and GWLj+1, respectively. The data line DLi delivers a data signal Di. The data signal Di may have a voltage level corresponding to the image signal RGB input to the display device DD (see FIG. 2). The first to fourth driving voltage lines VL1, VL2, VL3, and VL4 may deliver the first driving ELVDD, the second driving voltage ELVSS, the first initialization voltage VINT1, and the second initialization voltage VINT2, respectively. The first initialization voltage VINT1 and the second initialization voltage VINT2 may have different voltage levels from each other. In another embodiment, the first initialization voltage VINT1 and the second initialization voltage VINT2 may have the same voltage level.

The first transistor T1 includes a first electrode connected to the first driving voltage line VL1 via the fifth transistor T5, a second electrode electrically connected to an anode of the light emitting diode ED via the sixth transistor T6, and a gate electrode connected to one end of the capacitor Cst. The first transistor T1 receives the data signal Di that is delivered by the data line DLi according to a switching operation of the second transistor T2, and provides a driving current Id to the light emitting diode ED.

The second transistor T2 includes a first electrode connected to the data line DLi, a second electrode connected to the first electrode of the first transistor T1, and a gate electrode connected to the third scan line GWLj. The second transistor T2 may be turned on according to the third scan signal GWj delivered through the third scan line GWLj and then deliver the data signal Di, which has been delivered from the data line DLi, to the first electrode of the first transistor T1.

The third transistor T3 includes a first electrode connected to the gate electrode of the first transistor T1, a second electrode connected to the second electrode of the first transistor T1, and a gate electrode connected to the second scan line GCLj. The third transistor T3 may be turned on according to the second scan signal GCj delivered through the second scan line GCLj and then diode-connect the first transistor T1 by connecting the gate electrode and the second electrode of the first transistor T1.

The fourth transistor T4 includes a first electrode connected to the gate electrode of the first transistor T1, a second electrode connected to a third driving voltage line VL3 through which the first initialization voltage VINT1 is delivered, and a gate electrode connected to the first scan line GILj. The fourth transistor T4 may be turned on according to the first scan signal GIj delivered through the first scan line GILj and then deliver the initialization voltage VINT1 to the gate electrode of the first transistor T1, and thus perform an initialization operation for initializing a voltage of the gate electrode of the first transistor T1.

The fifth transistor T5 includes a first electrode connected to the first driving voltage line VL1, a second electrode connected to the first electrode of the first transistor T1, and a gate electrode connected to the light emission control line EMLj.

The sixth transistor T6 includes a first electrode connected to the second electrode of the first transistor T1, a second electrode connected to the anode of the light emitting diode ED, and a gate electrode connected to the light emission control line EMLj.

The fifth transistor T5 and the sixth transistor T6 may be substantially simultaneously turned on according to the light emission control signal EMj delivered through the light emission control line EMLj, and, through this, the first driving voltage ELVDD, which is compensated through the diode-connected first transistor T1, may be delivered to the light emitting diode ED.

The seventh transistor T7 includes a first electrode connected to the fourth driving voltage line VL4, a second electrode connected to the second electrode of the sixth transistor T6, and a gate electrode connected to the fourth scan line GWLj+1. In alternative embodiment, the first electrode of the seventh transistor T7 may be connected to the third driving voltage line VL3 instead of the fourth driving voltage line VL4.

As described above, one end of the capacitor Cst is connected to the gate electrode of the first transistor T1, and the other end is connected to the first driving voltage line VL1. A cathode of the light emitting diode ED may be connected to the second driving voltage line VL2 for delivering the second driving voltage ELVSS. The structure of the pixel PXij according to an embodiment is not limited to the structure shown in FIG. 3, and the numbers of transistors and the capacitors included in one pixel and the connection relationship thereof may be modified in various ways.

Figure 4:
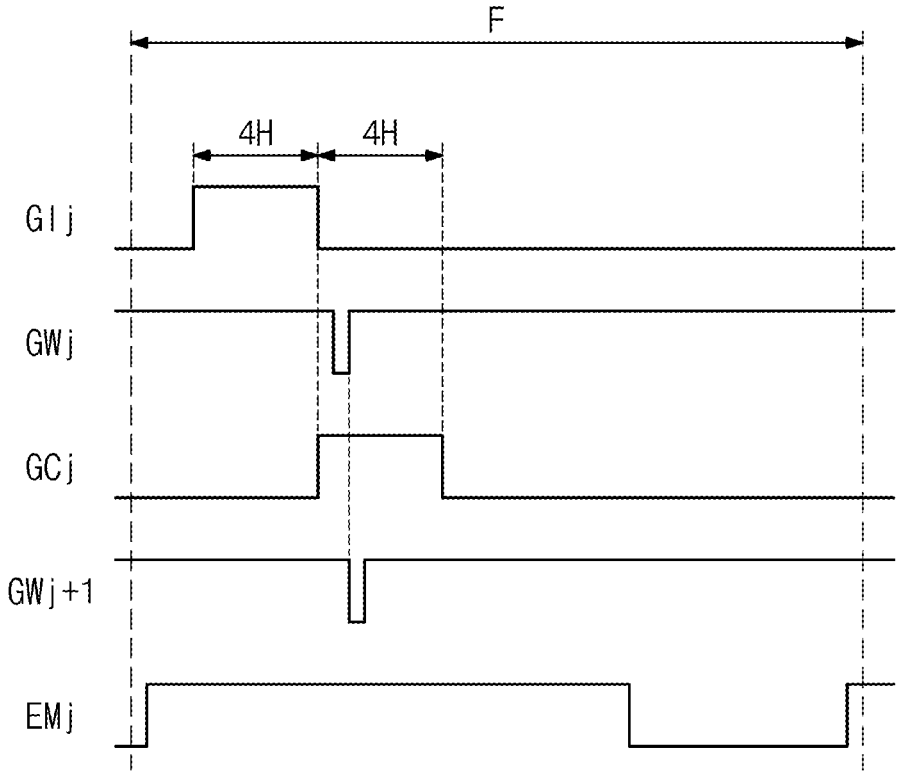
FIG. 4 is a timing diagram showing an operation of a pixel of the display device of FIG. 3.

FIG. 4 is a timing diagram showing an operation of the pixel of the display device of FIG. 3. The operation of the display device according to an embodiment will be described with reference to FIGS. 3 and 4.

Referring to FIGS. 3 and 4, the first scan signal GIj of a high level is supplied through the first scan line GILj during an initialization period within one frame. The fourth transistor T4 is turned on in response to the first scan signal GIj of the high level, the first initialization voltage VINT1 is delivered to the gate electrode of the first transistor T1 through the fourth transistor T4, and thus the first transistor T1 is initialized.

Then, during a data programming and compensation period, when the second scan signal GCj of the high level is provided through the second scan line GCLj, the third transistor T3 is turned on. The first transistor T1 is diode-connected by the turned-on third transistor T3 and biased in a forward direction. Each pulse width of the first scan signal GIj and the second scan signal GCj may be four horizontal sections 4H. The horizontal section H indicates a time during which pixels PX in one row of the display panel DP (see FIG. 2) in the first direction DR1 are driven.

When the third scan signal GWj of a low level is supplied through the third scan line GWLj, the second transistor T2 is turned on. Then, a compensation voltage is applied to the gate electrode of the first transistor T1. Here, the compensation voltage amounts to a voltage value reduced by a threshold voltage of the first transistor T1 from a voltage value of the data signal Di. In other words, the gate voltage applied to the gate electrode of the first transistor T1 may be the compensation voltage.

The first driving voltage ELVDD and the compensation voltage are applied to both ends of the capacitor Cst, respectively, and charges corresponding to the voltage difference between the both ends may be stored in the capacitor Cst.

On the other hand, the seventh transistor T7 receives the fourth scan signal GWj+1 of the low level through the fourth scan line GWLj+1 to be turned on. A portion of the driving current Id may be drawn out through the seventh transistor T6 as a bypass current Ibp.

Even when the minimum current of the first transistor T1, which displays a black image, flows as the driving current Id, the black image may not be properly displayed when the light emitting diode ED emits light. Accordingly, as the bypass current Ibp, the seventh transistor T7 in the pixel PXij according to an embodiment of the inventive concept may disperse a portion of the minimum current of the first transistor T1 to a current path other than a current path of an organic light emitting diode side. Here, the minimum current of the first transistor T1 means a current under a condition that a gate-source voltage of the first transistor T1 is smaller than the threshold voltage to turn off the first transistor T1. Under this condition of turning off the first transistor T1, the minimum driving current (for example, a current of 10 picoamperes (pA) or smaller) is delivered to the light emitting diode ED to cause a black luminance image to be represented. When the minimum driving current for displaying the black image flows, an influence on the bypass and delivery by the bypass current Ibp is large. However, when a large driving current Id for displaying an image such as a typical image or a white image flows, there is little influence by the bypass current Ibp. Accordingly, when displaying the black image, the emission current Ted of the light emitting diode ED, which is reduced from the driving current Id by a current amount of the bypass current Ibp drawn out through the seventh transistor T7, has a minimum current amount that reliably represents the black image. Accordingly, a contrast ratio may be improved by implementing an accurate black luminance image using the seventh transistor T7. In this embodiment, the bypass signal is the fourth scan signal GWj+1, but is not always limited thereto.

Then, during the light emission period, the light emission control signal EMj supplied from the light emission control line EMLj is changed from the high level to the low level. During the emission period, the fifth transistor T5 and the sixth transistor T6 are turned on by the emission control signal EMj. Then, the driving current Id is generated according to the voltage difference between the gate voltage of the gate electrode of the first transistor T1 and the first driving voltage ELVDD, the driving current Id is supplied to the light emitting diode ED through the sixth transistor T6, and the current led flows to the light emitting diode ED. During the light emission period, the gate-source voltage of the first transistor T1 is maintained as 'the compensation voltage minus the first driving voltage ELVDD' by the capacitor Cst. According to the current-voltage relationship of the first transistor T1, the driving current Id may be proportional to '(the voltage value of the data signal Di minus the first driving voltage ELVDD)$^2$' that is square of a value obtained by subtracting the threshold voltage from the gate-source voltage of the first transistor T1. Accordingly, the driving current Id may be determined regardless of the threshold voltage of the first transistor T1.

Figure 5:
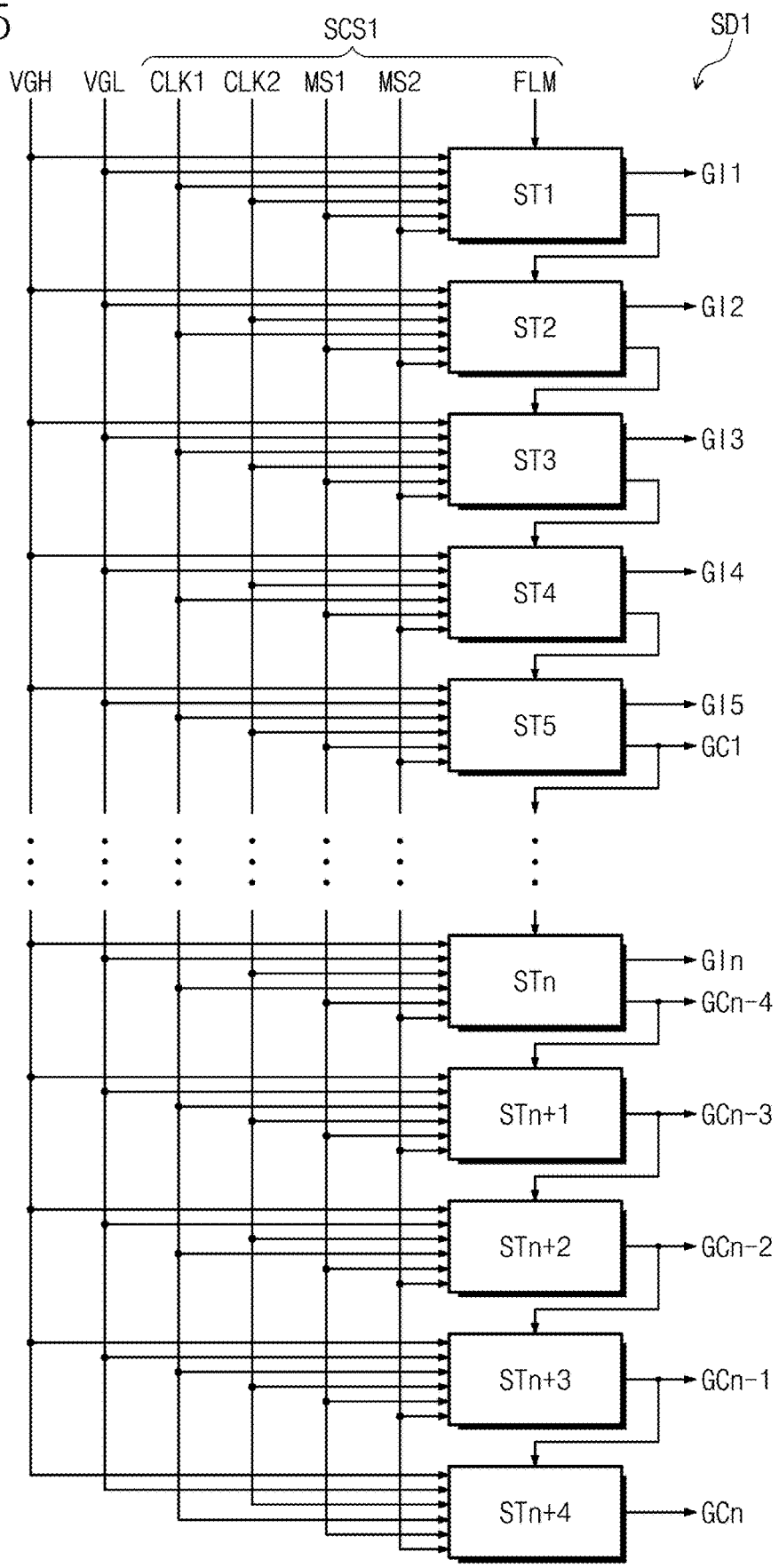
FIG. 5 is a block diagram of a first scan driving circuit according to an embodiment of the inventive concept.

FIG. 5 is a block diagram of the first scan driving circuit SD1 according to an embodiment of the inventive concept.

Referring to FIG. 5, the scan driving circuit SD1 includes driving stages ST1 to STn+4.

Each of the driving stages ST1 to STn+4 receives the first scan control signal SCS1 from the driving controller 100 illustrated in FIG. 2. The first scan control signal SCS1 includes a start signal FLM, a first clock signal CLK1, a second clock signal CLK2, a first masking signal MS1, and a second masking signal MS2. Each of the driving stages ST1 to STn+4 receives a first voltage VGL and a second voltage VGH. The first voltage VGL and the second voltage VGH may be provided from the voltage generator 300 illustrated in FIG. 2.

The first masking signal MS1 and the second masking signal MS2 are signals for driving a part of the driving stages ST1 to STn+4 at a normal frequency (e.g., 120 Hertz), and driving the rest of the driving stages ST1 to STn+4 at a low frequency (e.g., 1 Hz).

In an embodiment, the driving stages ST1 to STn+4 output the first scan signals GI1 to GIn and the second scan signals GC1 to GCn. The first scan signals GI1 to GIn may be provided to the first scan lines GIL1 to GILn illustrated in FIG. 2, and the second scan lines GC1 to GCn may be provided to the second scan lines GCL1 to GCLn illustrated in FIG. 2.

The driving stage ST1 may receive the start signal FLM as a carry signal. Each of the driving stages ST1 to STn+4 has a dependent coupling relationship in which the second scan signal output from the previous driving stage is received as a carry signal. In one embodiment, for example, the driving stage ST2 receives the second scan signal GC1 output from the previous driving stage ST1 as a carry signal, and the driving stage ST3 receives the second scan signal GC2 output from the previous driving stage ST2 as a carry signal.

Figure 6:
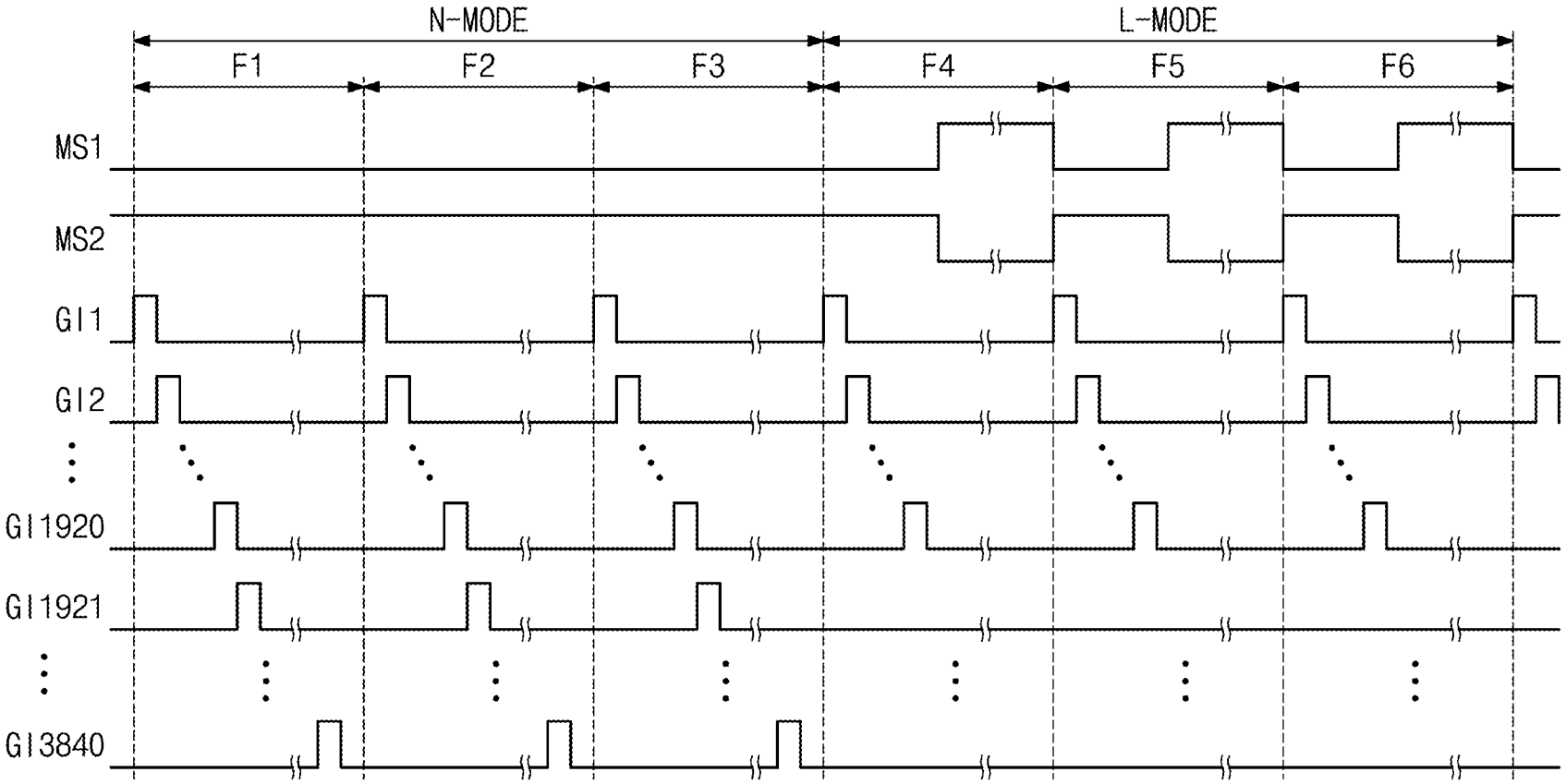
FIG. 6 shows exemplary first scan signals output from the first scan driving circuit ("SD1") shown in FIG. 5 in a normal mode and a low power mode.

FIG. 6 exemplarily shows the first scan signals GI1 to GIn output from the first scan driving circuit SD1 shown in FIG. 5 in a normal mode and a low power mode.

Referring to FIGS. 5 and 6, during the normal mode N-MODE, the first masking signal MS1 may be maintained at a first level (e.g., a low level), and the second masking signal MS2 may be maintained at a second level (e.g., a high level).

Figure 7:
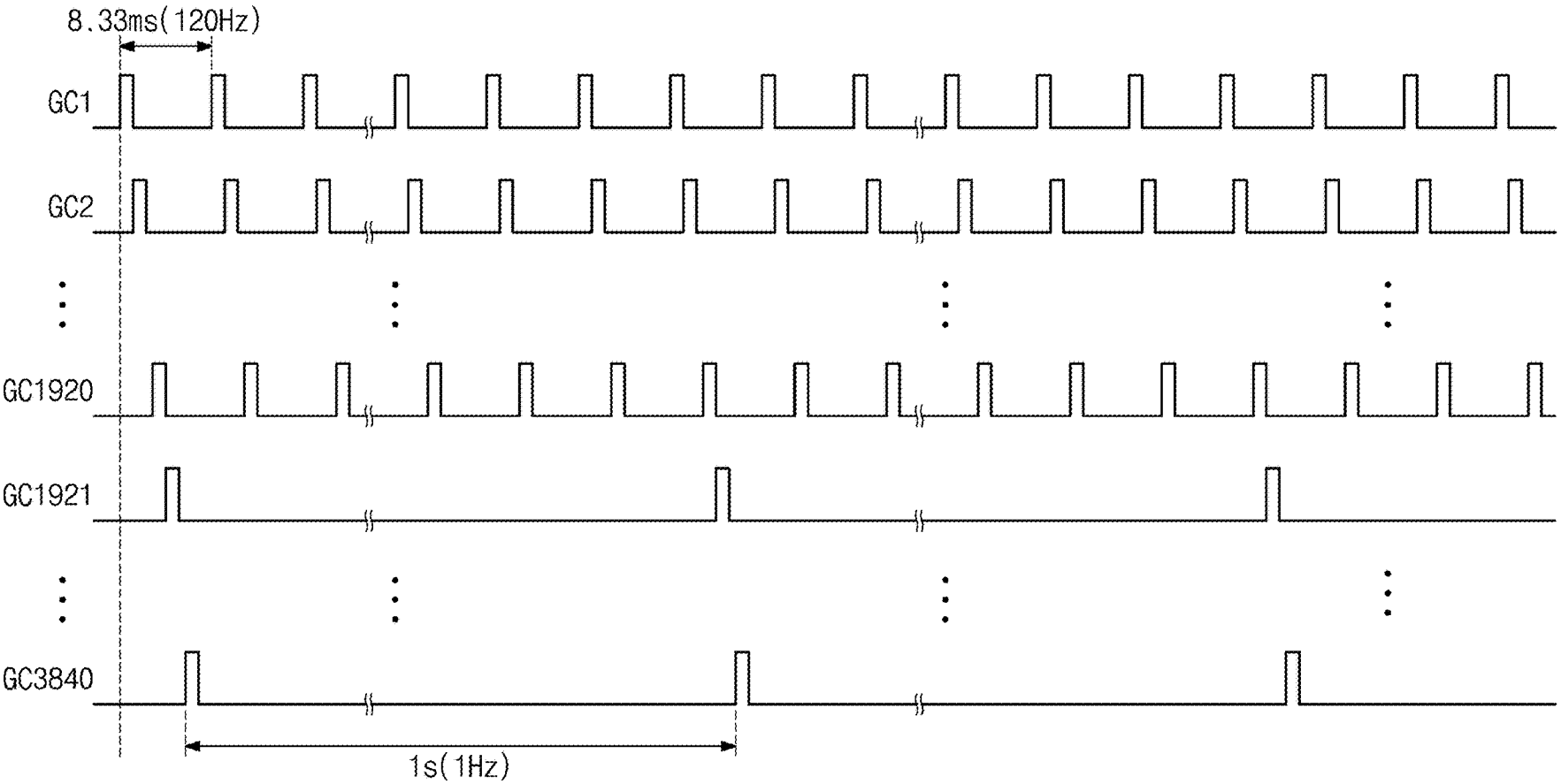
FIG. 7 shows exemplary second scan signals in a low power mode.

In the normal mode N-MODE, the driving stages ST1 to STn+4 sequentially output the first scan signals GI1 to GIn at the high level in each of frames F1, F2 and F3. In FIGS. 6 and 7, an example where n is 3840 is exemplary used.

In the low power mode L-MODE, the first masking signal MS1 is changed from the low level to the high level at a start point of the second display area DA2 (see FIG. 1) driven at a low frequency (e.g., 1 Hz), and is changed again to the low level when a next frame (e.g., F5) starts. The second masking signal MS2 is changed from the high level to the low level at a start point of the second display area DA2, and then is changed again to the high level when the next frame (e.g., F5) starts.

In other words, the first masking signal MS1 is maintained at a first level (e.g., the low level) in the normal mode N-MODE, and is periodically changed between a second level (e.g., the high level) and the first level in the low power mode L-MODE. The second masking signal MS2 is maintained at the second level in the normal mode N-MODE, and is periodically changed between the second level and the first level in the low power mode L-MODE.

In one embodiment, for example, when the low power mode L-MODE starts from the fourth frame F4, the first image IM1 as shown in FIG. 1 may be displayed in the first display area DA1, and the second image IM2 may be displayed in the second display area DA2. While the first masking signal MS1 is maintained at the low level and the second masking signal MS2 is maintained at the high level in the fourth frame F4, first scan signals GI1 to GI1920 may be sequentially driven at the high level. In the fourth frame F4, when the first masking signal MS1 is changed to the high level and the second masking signal MS2 is changed to the low level, the first scan signals GI1921 to GI3840 may be maintained at the low level. When the fourth frame F4 ends and a fifth frame F5 starts, the first masking signal MS1 may be changed again to the low level and the second masking signal MS2 may be changed again to the high level.

As similar to the fourth frame F4, in the fifth frame F5, while the first masking signal MS1 is at the low level and the second masking signal MS2 is at the high level, the first scan signals GI1 to GI1920 may be sequentially driven at the high level. While the first masking signal MS1 is changed to the high level and the second masking signal MS2 is changed to the low level in the middle of the fifth frame F5, the first scan signals GI1921 to GI3840 are maintained at the low level.

FIG. 7 shows exemplary second scan signals GC1 to GCn in a low power mode.

Referring to FIG. 7, the frequency of the second scan signals GC1 to GC1920 is 120 Hz in the low power mode, and the frequency of the second scan signals GC1921 to GC3840 is 1 Hz in the low power mode. Although not shown in the drawing, the first scan signals GI1 to GI3840 may have the same waveforms as the second scan signals GC1921 to GC3840 in the low power mode.

In one embodiment, for example, the second scan signals GC1 to GC1920 correspond to the first display area DA1 of the display device DD shown in FIG. 1, and the second scan signals GC1921 to GC3840 correspond to the second display area DA2. The first display area DA1 in which the moving image is displayed is driven by the second scan signals GC1 to GC1920 of the normal frequency (e.g., 120 Hz). In other words, the first display area DA1 may be refreshed with a new image signal for every 8.34 milliseconds (ms). The second display area DA2 in which the still image is displayed is driven by the second scan signals GC1921 to GC3840 of the low frequency (e.g., 1 Hz). In other words, the second display area DA2 may be refreshed with a new image signal for every 1 second.

In this way, since only the second display area DA2 in which the still image is displayed is driven at the low frequency (e.g., 1 Hz), power consumption may be reduced without degradation of the display quality. In the low power mode L-MODE, a part of the second scan signals GC1 to GC3840 is driven at the normal frequency (e.g., 120 Hertz), and the rest of the second scan signals GC1 to GC3840 is driven at the lower frequency (e.g., 1 Hz) than the normal frequency. Accordingly, the low power mode may be referred to as a multi-frequency mode.

Figure 8:
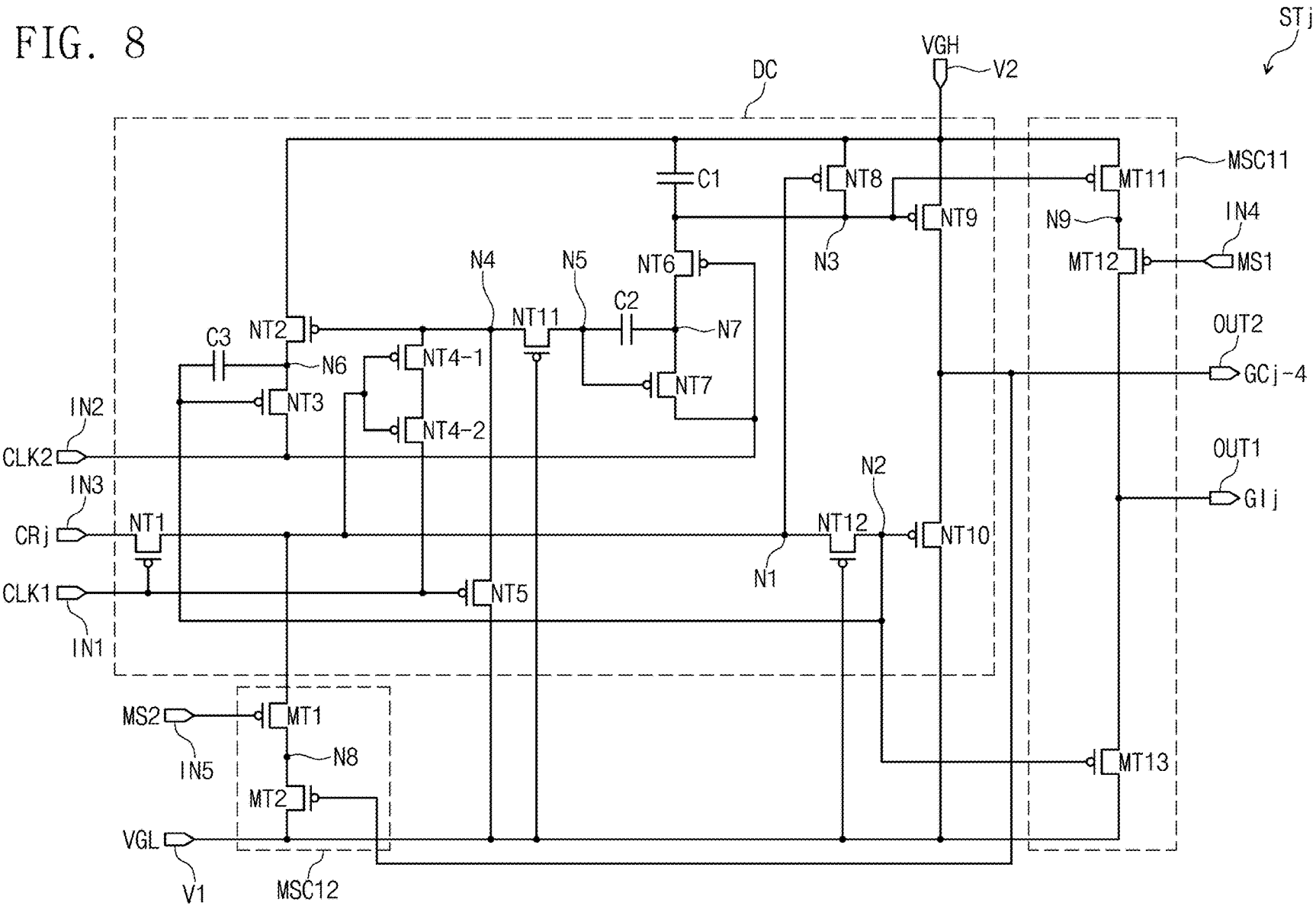
FIG. 8 is a circuit diagram showing a j-th driving stage in a first scan driving circuit according to an embodiment of the inventive concept.

FIG. 8 is a circuit diagram showing the j-th driving stage STj in the first scan driving circuit SD1 according to an embodiment of the inventive concept.

FIG. 8 exemplarily illustrates the j-th driving stage STj (where, j is a positive integer and less than or equal to n+4) among the driving stages ST1 to STn+4 illustrated in FIG. 5. Each of the plurality of driving stages ST1 to STn+4 illustrated in FIG. 5 may include the same circuit as the j-th driving stage STj. Hereinafter, the j-th driving stage STj is referred to as a driving stage STj.

Referring to FIG. 8, the driving stage STj includes a driving circuit DC, a first masking circuit MSC11, a second masking circuit MSC12, first to fifth input terminals IN1 to IN5, and first and second output terminals OUT1 and OUT 2.

The driving circuit DC includes transistors NT1 to NT12 and capacitors C1 to C3.

The driving circuit DC receives a first clock signal CLK1, a second clock signal CLK2, and a carry signal CRj through the first to third input terminals IN1 to IN3, respectively. The driving circuit DC receives a first voltage VGL and a second voltage VGH through a first voltage terminal V1 and a second voltage terminal V2, respectively. The driving circuit DC outputs a first scan signal GIj through the first output terminal OUT1, and a second scan signal GCj−4 through the second output terminal OUT2. The j-th driving stage STj may receive a second scan signal GCj−5, which is output through the second output terminal OUT2 of the (j−1)-th driving stage STj−1, as the carry signal CRj. The (j+1)-th driving stage STj+1 may receive the second scan signal GCj−4, which is output through the second output terminal OUT2 of the j-th driving stage STj, as the carry signal CRj.

The carry signal CR1 of the driving stage ST1 illustrated in FIG. 5 may be the start signal FLM.

The first input terminal IN1 of each of some driving stages (e.g., odd-numbered driving stages) among the driving stages ST1 to STn+4 illustrated in FIG. 5 receives the first clock signal CLK1, and the second input terminal IN2 thereof receives the second clock signal CLK2. In addition, the second input terminal IN2 of each of some driving stages (e.g., even-numbered driving stages) among the driving stages ST1 to STn+4 receives the first clock signal CLK1, and the first input terminal IN1 thereof receives the second clock signal CLK2.

The transistor NT1 is connected between the third input terminal IN3 and a first node N1, and includes a gate electrode connected to the first input terminal IN1. The transistor NT2 is connected between the second voltage terminal V2 and a sixth node N6, and includes a gate electrode connected to a fourth node N4. The transistor NT3 is connected between a sixth node N6 and the second input terminal IN2, and includes a gate electrode connected to a second node N2.

The transistors NT4-1 and NT4-2 are serially connected between the fourth node N4 and the first input terminal IN1. Each of the transistors NT4-1 and NT4-2 includes a gate electrode connected to the first node N1. The transistor NT5 is connected between the fourth node N4 and the first voltage terminal V1, and includes a gate electrode connected to the first input terminal IN1. The transistor NT6 is connected between a third node N3 and a seventh node N7, and includes a gate electrode connected to the second input terminal IN2. The transistor NT7 is connected between the seventh node N7 and the second input terminal IN2, and includes a gate electrode connected to a fifth node N5.

The transistor NT8 is connected between the second voltage terminal V2 and the third node N3, and includes a gate electrode connected to the first node N1. The transistor NT9 is connected between the second voltage terminal V2 and the second output node OUT2, and includes a gate electrode connected to the third node N3. The transistor NT10 is connected between the second output terminal OUT2 and the first voltage terminal V1, and includes a gate electrode connected to the second node N2. The transistor NT11 is connected between the fourth node N4 and the fifth node N5, and includes a gate electrode connected to the first voltage terminal V1. The transistor NT12 is connected between the first node N1 and the second node N2, and includes a gate electrode connected to the first voltage terminal V1.

The capacitor C1 is connected between the second voltage terminal V2 and the third node N3. The capacitor C2 is connected between the fifth node N5 and the seventh node N7. The capacitor C3 is connected between the sixth node N6 and the second node N2.

The first masking circuit MSC11 includes masking transistors MT11, MT12, and MT13. The first masking circuit MSC11 stops (or masks) the output of the first scan signal GIj in response to the first masking signal MSC1 received through a fourth input terminal IN4.

The masking transistor MT11 is connected between the second voltage terminal V2 and a ninth node N9 (in other words, "first masking node"), and includes a gate electrode connected to the third node N3. The masking transistor MT12 is connected between the ninth node N9 and the first output terminal OUT1, and includes a gate electrode connected to the fourth input terminal IN4. The masking transistor MT13 is connected between the first output terminal OUT1 and the first voltage terminal V1, and includes a gate electrode connected to the second node N2.

The second masking circuit MSC12 includes masking transistors MT1 and MT2. The second masking circuit MSC12 stops (or masks) the output of the second scan signal GCj−4 by discharging the first node N1 in response to the second masking signal MSC2 received through the fifth input terminal IN5.

The masking transistor MT1 is connected between the first node N1 and an eighth node N8 (in other words, "second masking node"), and includes a gate electrode connected to the fifth input terminal IN5. The masking transistor MT2 is connected between the eighth node N8 and the first voltage terminal V1, and includes a gate electrode connected to the second output terminal OUT2.

Typically, when the driving circuit DC is designed to output the first scan signal GIj and the second scan signal GCj, it may be designed to switch any one between the first scan signal GIj and the second scan signal GCj (e.g., the first scan signal GIj) on the basis of the other (e.g., the second scan signal GCj) to be output. In this case, the second scan signal GCj may be output at a normal voltage level, but the voltage level of the first scan signal GIj may be lowered. When the voltage level of the first scan signal GIj is lowered, the transistor T4 shown in FIG. 3 may not be sufficiently turned on, and thus a normal operation of the pixel PXij may not be guaranteed.

In contrast, in an embodiment of the inventive concept, when the first masking signal MS1 is at a low level, the first masking circuit MSC11 shown in FIG. 8 may output the second voltage VGH as the first scan signal GIj through the masking transistors MT11 and MT12. Accordingly, the voltage level of the first scan signal GIj in the embodiment may be maintained constant.

Figure 9:
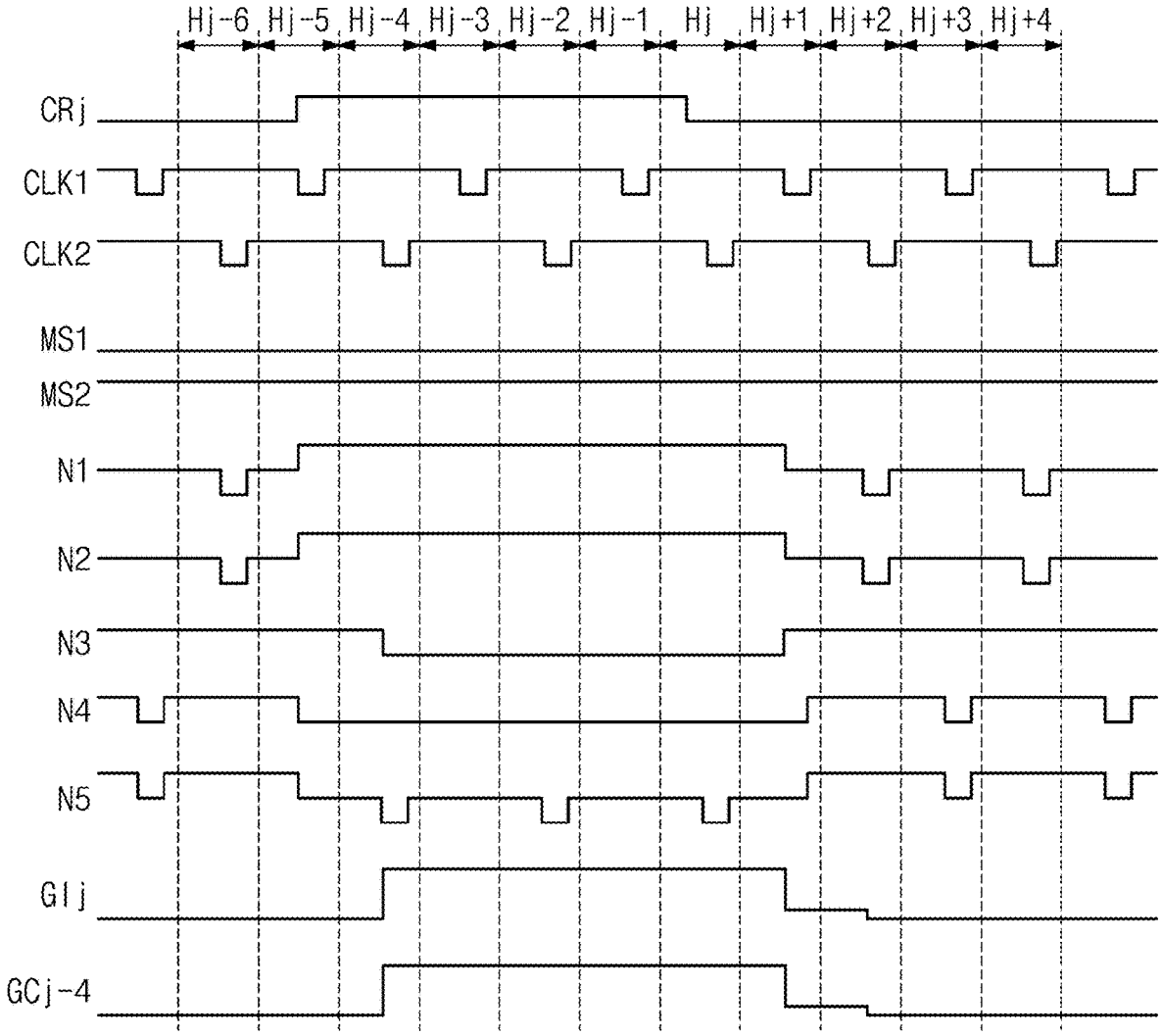
FIG. 9 is a timing diagram exemplarily showing an operation in a normal mode of the j-th driving stage in the first scan driving circuit shown in FIG. 8.

FIG. 9 is a timing diagram exemplarily showing an operation in the normal mode of the j-th driving stage STj in the first scan driving circuit SD1 shown in FIG. 8.

Referring to FIGS. 8 and 9, the first clock signal CLK1 and the second clock signal CLK2 have the same frequency, and transition to an active level (e.g., a low level) in different horizontal periods.

During the normal mode N-MODE, the first masking signal MS1 may be maintained at a first level (e.g., the low level), and the second masking signal MS2 may be maintained at a second level (e.g., a high level).

During the normal mode N-MODE, since the masking transistor MT12 in the first masking circuit MSC11 maintains a turn-on state by the first masking signal MS1 of the low level, the first scan signal GIj output from the first output terminal OUT1 may be determined according to signal levels of the second node N2 and the third node N3. A signal at the second node N2 may be a "first node signal", and a signal at the third node N3 may be a "second node signal".

During the normal mode N-MODE, since the masking transistor MT2 in the second masking circuit MSC12 maintains a turn-off state by the second masking signal MS2 of the high level, the first node N1 and the eighth node N8 maintain an electrically separated state.

When the first clock signal CLK1 is at the low level in a (j−5)-th horizontal period Hj−5, the transistor NT1 is turned on. As the transistor NT1 is turned on, the first node N1 and the second node N2 increase up to the high level according to a voltage level (e.g., 8 voltages (V)) of the carry signal CRj. When the first clock signal CLK1 is at the low level, the transistor NT5 is turned on to discharge the fourth node N4 and the fifth node N5 to the low level of the first voltage VGL (e.g., −6 V). On the other hand, as a voltage level at the first node N1 increases, the transistor NT8 is turned off.

When the second clock signal CLK2 is transitioned to the low level in the (j−4)-th horizontal period Hj−4, the transistor NT6 is turned on to discharge the charges at the third node N3 to the second input terminal IN2 through the transistors NT6 and NT7, and thus the signal (the second node signal) at the third node N3 is transitioned to the low level. As the signal at the third node N3 is transitioned to the low level, the transistor NT9 is turned on and thus the second scan signal GCj−4 at the high level may be output through the second output terminal OUT2. Here, since the signal at the first node N1 is at the high level, the masking transistor MT13 is turned off. Since the signal at the third node N3 is at the low level, the masking transistor MT11 is turned on and the first scan signal GIj at the high level may be output through the first output terminal OUT1.

When the first clock signal CLK1 is at the low level in the (j+1)-th horizontal period Hj+1 after the carry signal CRj is transitioned from the high level to the low level in a j-th horizontal period Hj, the transistor NT1 is turned on and the voltage levels of the first node N1 and the second node N2 are lowered to that (e.g., −6 V) of the carry signal CRj. As the transistor NT10 is turned on in response to a low-level signal of the second node N2, the second scan signal GCj−4 of the low level (e.g., −6 V) may be output. In addition, as the masking transistor MT13 is turned on in response to the low-level signal of the second node N2, the first scan signal GIj of the low level (e.g., −6 V) may be output.

As the second clock signal CLK2 becomes the low level in the (j+2)-th horizontal period Hj+2, the transistor NT3 is turned on, and the voltage levels of the first node N1 and the second node N2 are lowered to a lower level (e.g., −15 V). And thus, the voltage levels of the first scan signal GIj and the second scan signal GCj−4 may be lowered to the level (e.g., −8 V) of the first voltage VGL.

Figure 10:
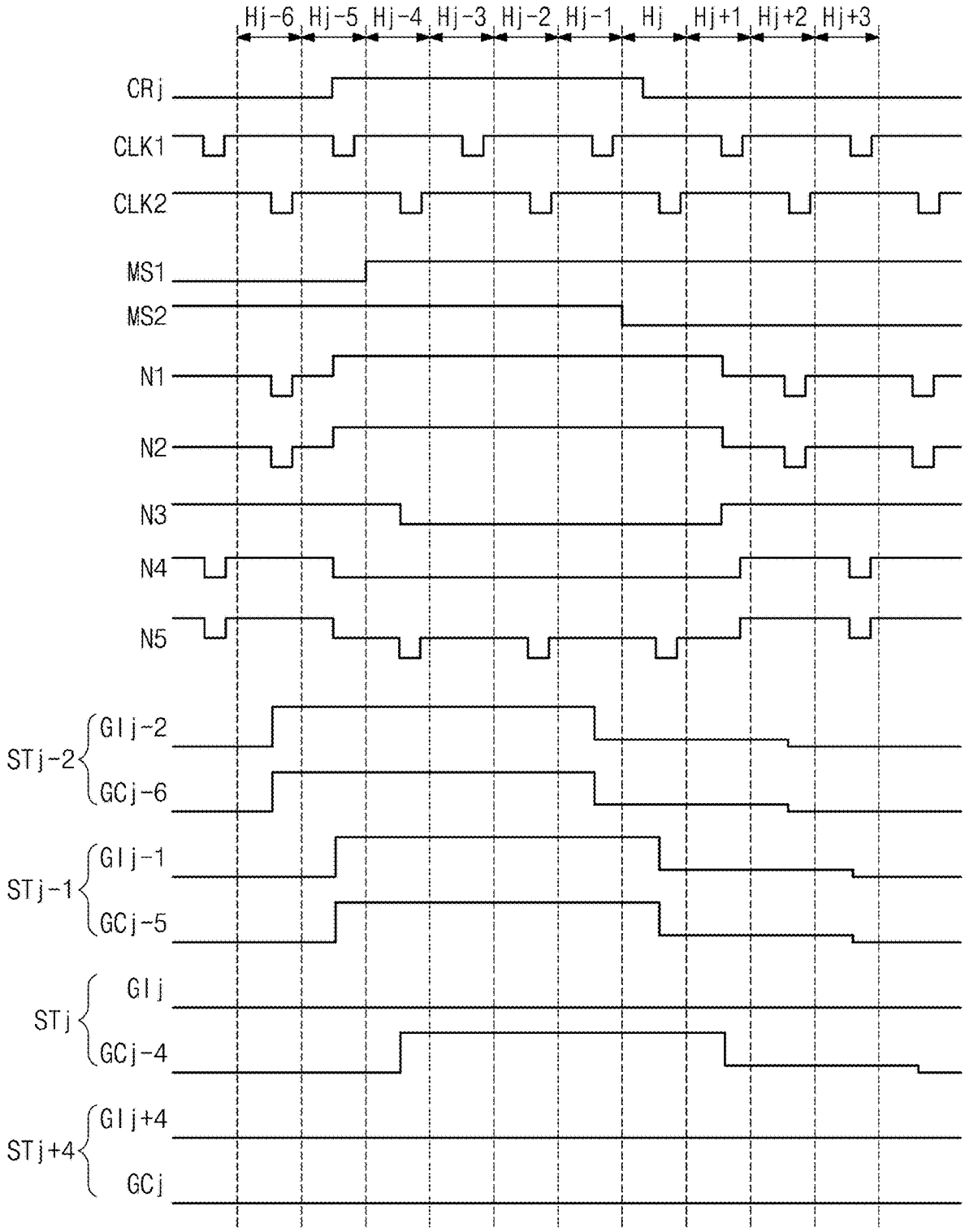
FIG. 10 is a timing diagram exemplarily showing an operation in a low power mode of the j-th driving stage in the first scan driving circuit shown in FIG. 8.

FIG. 10 is a timing diagram exemplarily showing a lower power mode operation of the j-th driving stage STj in the first scan driving circuit SD1 shown in FIG. 8.

With reference to FIGS. 8 and 10, the first masking signal MS1 is changed from the low level to the high level at a start point of the second display area DA2 (see FIG. 1) to be driven at a low frequency (e.g., 1 Hz) in the low power mode, and the second masking signal MS2 is changed from the high level to the low level. In an embodiment, the first masking signal MS1 is changed first from the low level to the high level, and then the second masking signal MS2 may be transitioned from the high level to the low level after the four horizontal periods 4H.

When the first masking signal MS1 is changed to the high level, the masking transistor MT12 in the first masking circuit MSC11 is turned off. Even when the masking transistor MT12 is turned off, the first scan signals GIj−2 and GIj−1, which have been already transitioned to the high level, may be maintained at the high level by capacitance components on the first scan lines GIj−2 and GIj−1. The first scan signal GIj, which has not yet been transitioned to the high level, may not become the high level and is maintained at the low level regardless of the voltage level of the third node N3.

When the second masking signal MS2 is transitioned to the low level, the masking transistor MT1 in the second masking circuit MSC12 is turned on to electrically connect the first node N1 and the eighth node N8. Since the transistor MT2 in the second masking circuit MSC12 operates in response to the second scan signal GCj−4 output to the second output terminal OUT2, the second scan signals GCj−6, GCj−5, and GCj−4, which has been already transitioned to the high level, may be maintained at the high level, even when the second masking signal MS2 is transitioned to the low level.

When the second masking signal MS2 is transitioned to the low level, the driving stage STj+4 receives the second scan signal GCj of the low level as the carry signal CRj, and thus the driving stage STj+4 may output the second scan signal GCj of the low level.

Referring to FIG. 3 again, the pixel PXij of the j-th row is connected with the j-th first scan line GILj and the j-th second scan line GCLj. When it is intended to drive the pixels in the (j−1)-th row at the normal frequency (e.g., 120 Hertz) and drive the pixels of the j-th row at the low frequency (e.g., 1 Hz), the (j−1)-th first scan signal GIj and the (j−1)-th second scan signal GCj are to be output at the normal frequency.

The j-th driving stage STj shown in FIG. 8 outputs the j-th first scan signal GIj to the first output terminal OUT1, and the (j−4)-th second scan signal GCj−4 to the second output terminal OUT2.

Accordingly, the driving controller 100 shown in FIG. 2 changes the first masking signal MSA from the low level to the high level in the (j−4)-th horizontal period Hj, and then changes the second masking signal MS2 from the high level to the low level in the j-th horizontal period Hj. In this way, according to the connection relationships between the pixel PXij and the scan lines, the driving controller 100 may set the signal levels of the first masking signal MS1 and the second masking signal MS2.

Figure 11:
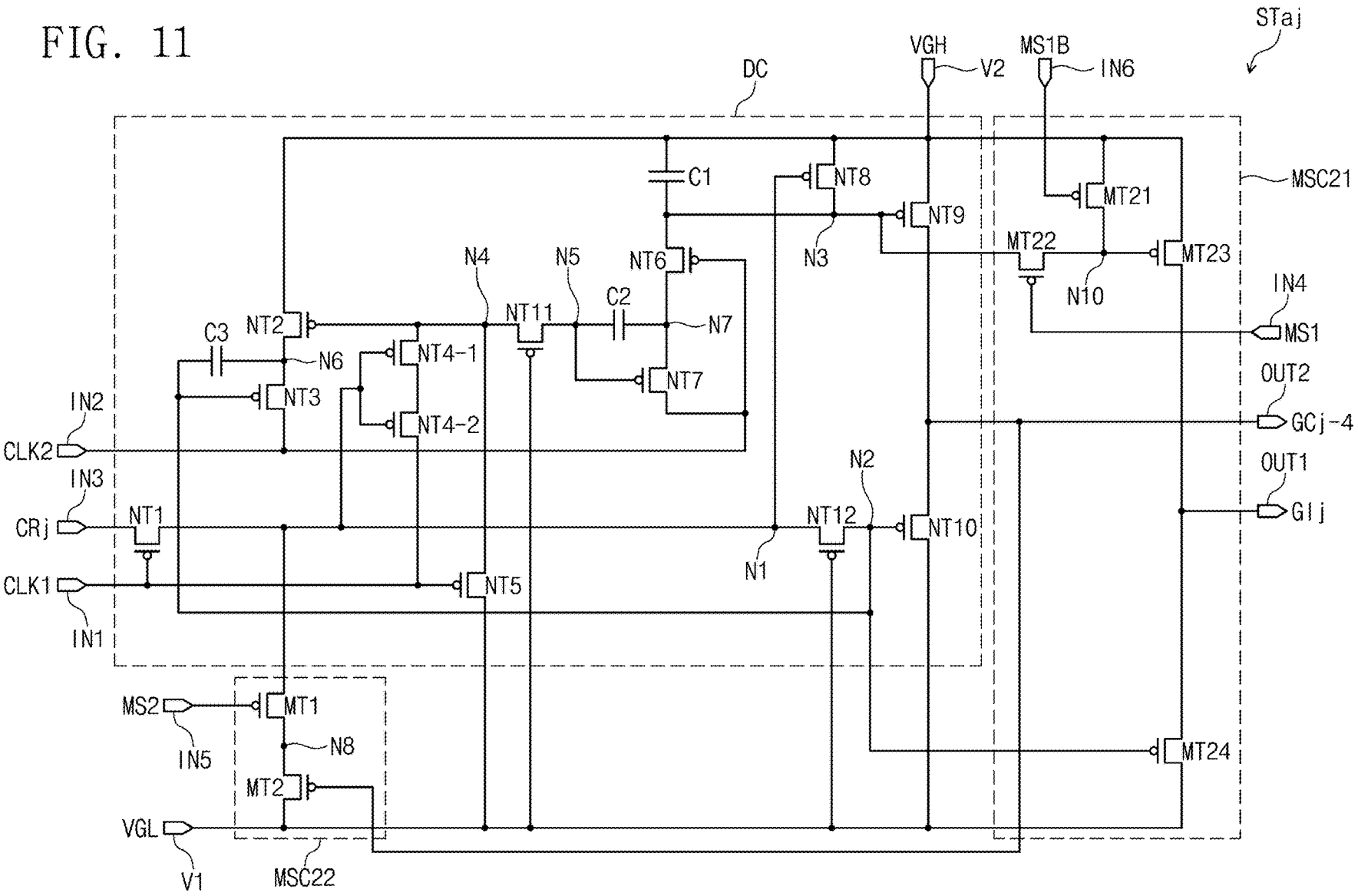
FIG. 11 is a circuit diagram showing the j-th driving stage in the first scan driving circuit according to another embodiment of the inventive concept.

FIG. 11 is a circuit diagram showing a j-th driving stage STaj in the first scan driving circuit SD1 according to another embodiment of the inventive concept.

Referring to FIG. 11, the driving stage STaj includes a driving circuit DC, a first masking circuit MSC21, and a second masking circuit MSC22. The driving circuit DC and the second masking circuit MSC22 shown in FIG. 11 may include the same circuit configuration as the driving circuit DC and the second masking circuit MSC12 of the driving stage STj shown in FIG. 8. The first masking circuit MSC21 of the driving stage STaj is different from the first masking circuit MSC11 of the driving stage STj in FIG. 8. The driving stage STaj further includes a sixth input terminal IN6 that receives the third masking signal MS1B. The third masking signal MS1B may be a complementary signal with the first masking signal MS1. That is, the first masking signal MS1 and the third masking signal MS1B have opposite signal patterns from each other as shown in FIG. 12.

The first masking circuit MSC21 includes masking transistors MT21, MT22, MT23, and MT24. The first masking circuit MSC21 stops (or masks) the output of the first scan signal GIj in response to the first masking signal MS1 received through the fourth input terminal IN4 and the third masking signal MS1B received through the sixth input terminal IN6.

The masking transistor MT21 is connected between the second voltage terminal V2 and a tenth node N10 (this can be "first masking node" in FIG. 11), and includes a gate electrode connected to the sixth input terminal IN6. The masking transistor MT22 is connected between the third node N3 and the tenth node N10, and includes a gate electrode connected to the fourth input terminal IN4. The transistor MT23 is connected between the second voltage terminal V2 and the first output node OUT1, and includes a gate electrode connected to the tenth node N10. The masking transistor MT24 is connected between the first output terminal OUT1 and the first voltage terminal V1, and includes a gate electrode connected to the second node N2.

Figure 12:
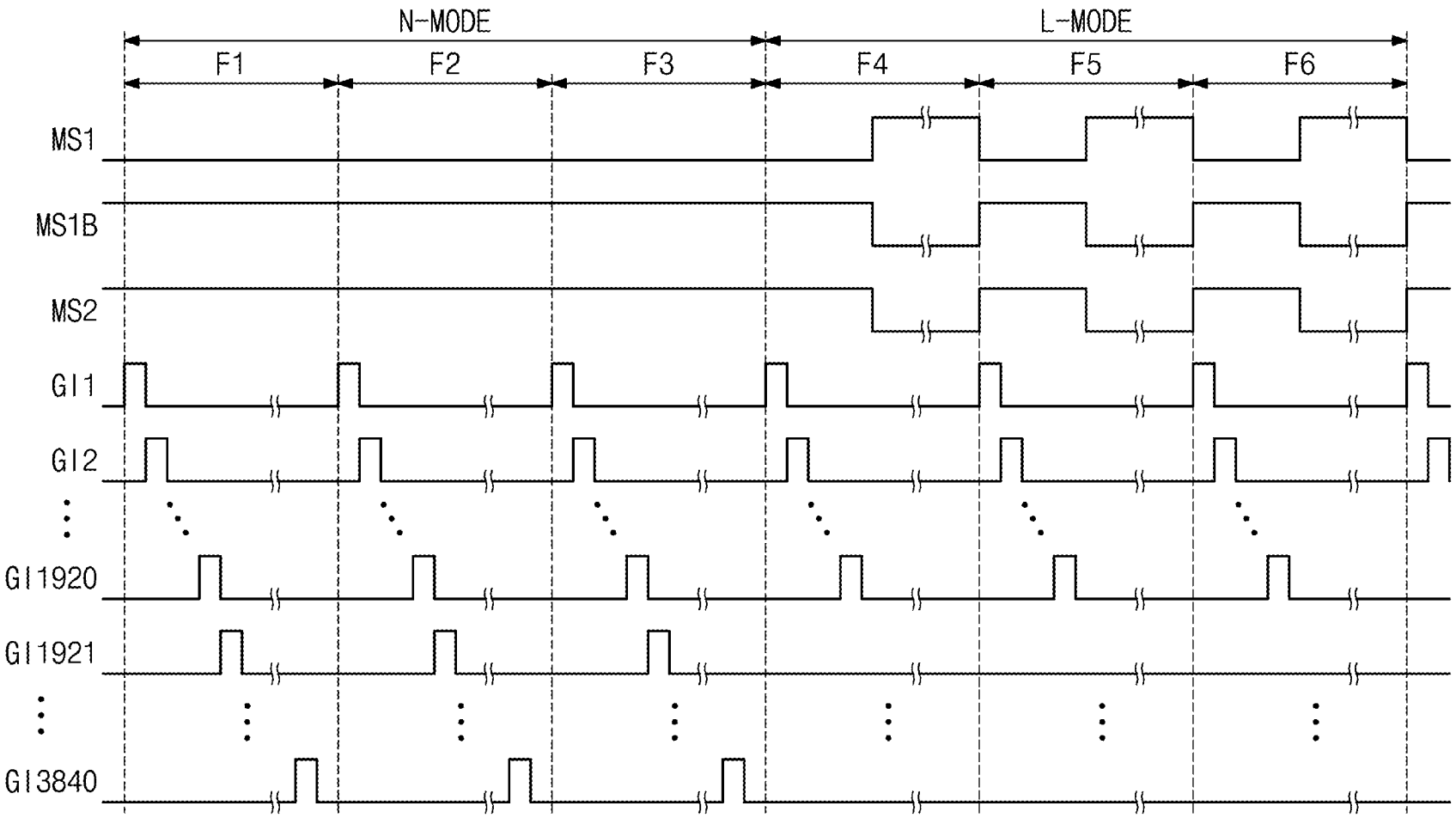
FIG. 12 exemplarily shows first to third masking signals and first scan signals output from the first scan driving circuit shown in FIG. 5 in a normal mode and a low power mode.

FIG. 12 exemplarily shows first to third masking signals and first scan signals GI1 to GIn output from the first scan driving circuit SD1 shown in FIG. 5 in the normal mode and the low power mode.

Referring to FIGS. 5, 11 and 12, during the normal mode N-MODE, the first masking signal MS1 may be maintained at a first level (e.g., the low level), and the second masking signal MS2 and the third masking signal MS1B may be maintained at a second level (e.g., the high level).

During the normal mode N-MODE, the driving stage STaj operates in response to the first masking signal MS1 of the low level and the second masking signal MS2 and the third masking signal MS3 of the high level.

While the first masking signal MS1 is at the low level and the third masking signal MS1B is at the high level, the masking transistor MT22 in the first masking circuit MSC21 maintains a turn-on state, and the masking transistor MT21 maintains a turn-off state. Accordingly, the first scan signal GIj output from the first output terminal OUT1 may be determined according to the signal levels of the third node N3 and the second node N2.

During the normal mode N-MODE, since the masking transistor MT2 in the second masking circuit MSC12 maintains the turn-off state by the second masking signal MS2 of the high level, the first node N1 and the eighth node N8 maintain an electrically separated state.

Accordingly, during the normal mode N-MODE, the first scan signals GI1 to GI3840 may be sequentially driven at the high level.

During the low power mode L-MODE, when the first masking signal MS1 is changed to the high level and the third masking signal MS1B is changed to the low level, the masking transistor MT22 in the first masking circuit MSC21 is turned off and the masking transistor MT21 is turned on. Through the turned-on masking transistor MT21, the second voltage VGH is delivered to the tenth node N10 and thus the masking transistor MT23 is turned off. When the signal at the second node N2 is at the low level, the masking transistor MT24 is turned on to output the first scan signal GIj of the low level (e.g., −6 V).

Accordingly, when the first masking signal MS1 is changed to the high level and the third masking signal MS1B is changed to the low level in the low power mode L-MODE, the first scan signals GI1 to GI1920 may not be driven at the high level and be maintained at the low level.

When the first masking signal MS1 is at the low level, the first masking circuit MSC11 shown in FIG. 8 may output the second voltage VGH as the first scan signal GIj through the masking transistors MT11 and MT12. Accordingly, the voltage level of the first scan signal GIj may be maintained constant. But the size of the masking transistor MT12 is required to be sufficiently large so that the masking transistor MT12 is sufficiently turned on/off in response to the signal at the third node N3.

In contrast, in the first masking circuit MSC21 shown in FIG. 11, the signal at the third node N3 may be provided to the gate electrode of the masking transistor MT23 through the masking transistor MT22, and the second voltage VGH may be provided to the gate electrode of the masking transistor MT23 through the masking transistor MT21. Therefore, the size of the masking transistor MT23 may be smaller than the size of the masking transistor MT21 shown in FIG. 8.

Figure 13:
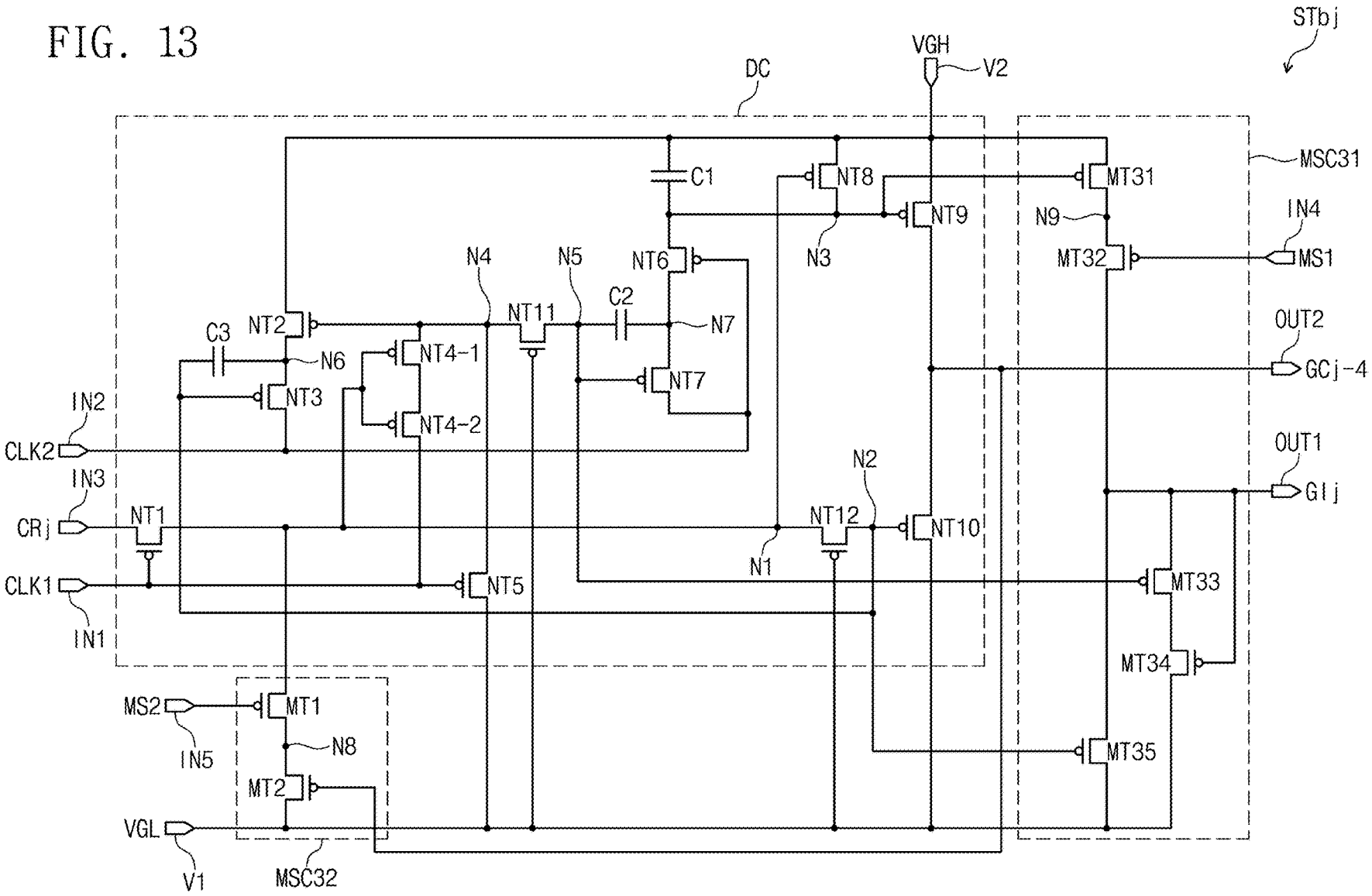
FIG. 13 is a circuit diagram showing the j-th driving stage in the first scan driving circuit according to still another embodiment of the inventive concept.

FIG. 13 is a circuit diagram showing a j-th driving stage STbj in the first scan driving circuit SD1 according to still another embodiment of the inventive concept.

Referring to FIG. 13, the driving stage STbj includes a driving circuit DC, a first masking circuit MSC31, and a second masking circuit MSC32. The driving circuit DC and the second masking circuit MSC32 of the driving stage STbj shown in FIG. 13 may include the same circuit configuration as the driving circuit DC and the second masking circuit MSC12 of the driving stage STj shown in FIG. 8. The first masking circuit MSC31 of the driving stage STbj is different from the first masking circuit MSC11 of the driving stage STj in FIG. 8.

The first masking circuit MSC31 includes masking transistors MT31, MT32, MT33, MT34, and MT35. The first masking circuit MSC31 stops (or masks) the output of the first scan signal GIj in response to the first masking signal MS1 received through the fourth input terminal IN4.

The masking transistor MT31 is connected between the second voltage terminal V2 and the ninth node N9, and includes a gate electrode connected to the third node N3. The masking transistor MT32 is connected between the ninth node N9 and the first output terminal OUT1, and includes a gate electrode connected to the fourth input terminal IN4.

The masking transistors MT33 and MT34 are serially connected between the first output terminal OUT1 and the voltage terminal V1. The masking transistor MT33 includes a gate electrode connected to the fifth node N5, and the masking transistor MT34 includes a gate electrode connected to the first output terminal OUT1. The masking transistor MT35 is connected between the first output terminal OUT1 and the first voltage terminal V1, and includes a gate electrode connected to the second node N2.

In the low power mode L-MODE, while the second scan signal GCj is at the low level, when the signal at the second node N2 is in a floating state, the masking transistor MT35 is turned off. The masking transistor MT33 and the masking transistor MT34 may discharge the first output terminal OUT1 to the first voltage VGL in response to the signal at the fifth node N5 (here, a signal at the fifth node N5 may be a "third node signal") and the second scan signal GCj. Accordingly, in the low power mode L-MODE, the second scan signal GCj may be stably maintained at the low level.

Figure 14:
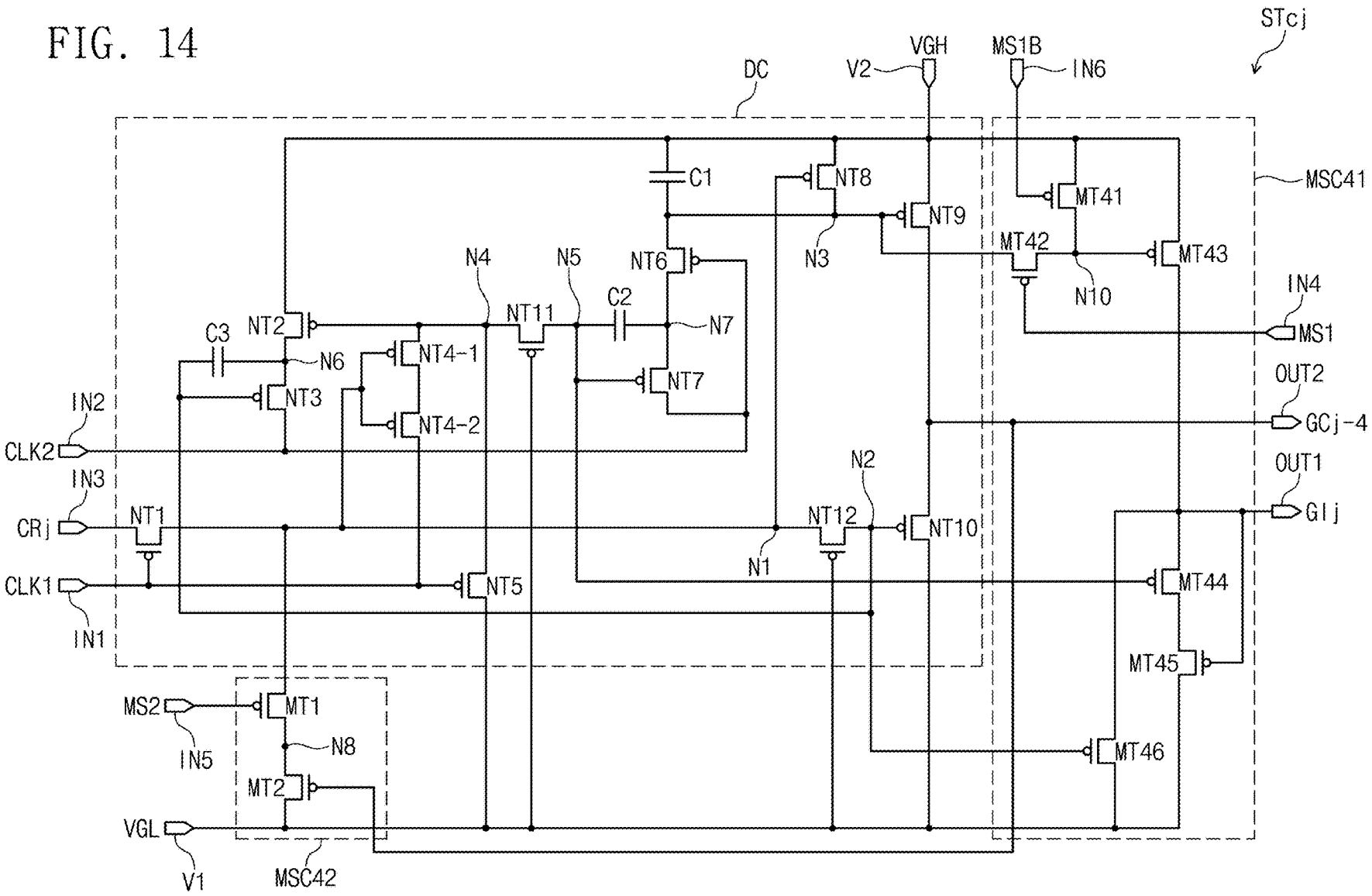
FIG. 14 is a circuit diagram showing the j-th driving stage in the first scan driving circuit according to yet another embodiment of the inventive concept.

FIG. 14 is a circuit diagram showing a j-th driving stage STcj in the first scan driving circuit SD1 according to yet another embodiment of the inventive concept.

Referring to FIG. 14, the driving stage STcj includes a driving circuit DC, a first masking circuit MSC41, and a second masking circuit MSC42. The driving circuit DC and the second masking circuit MSC42 of the driving stage STcj shown in FIG. 14 may include the same circuit configuration as the driving circuit DC and the second masking circuit MSC12 of the driving stage STj shown in FIG. 8. The first masking circuit MSC41 of the driving stage STcj is different from the first masking circuit MSC11 of the driving stage STj in FIG. 8. The driving stage STcj further includes a sixth input terminal IN6 that receives the third masking signal MS1B. The third masking signal MS1B may be a complementary signal with the first masking signal MS1.

The first masking circuit MSC41 includes masking transistors MT41, MT42, MT42, MT43, MT44, MT45, MT46, and MT47. The first masking circuit MSC41 stops (or masks) the output of the first scan signal GIj in response to the first masking signal MS1 received through the fourth input terminal IN4 and the third masking signal MS1B received through the sixth input terminal IN6.

The masking transistor MT41 is connected between the second voltage terminal V2 and the tenth node N10, and includes a gate electrode connected to the sixth input terminal IN6. The masking transistor MT42 is connected between the third node N3 and the tenth node N10, and includes a gate electrode connected to the fourth input terminal IN4. The transistor MT43 is connected between the second voltage terminal V2 and the first output node OUT1, and includes a gate electrode connected to the tenth node N10.

The masking transistors MT44 and MT45 are serially connected between the first output terminal OUT1 and the voltage terminal V1. The masking transistor MT44 includes a gate electrode connected to the fifth node N5, and the masking transistor MT45 includes a gate electrode connected to the first output terminal OUT1. The masking transistor MT46 is connected between the first output terminal OUT1 and the first voltage terminal V1, and includes a gate electrode connected to the second node N2.

The size of the masking transistor MT43 in the first masking circuit MSC41 may be smaller than the size of the masking transistor MT12 shown in FIG. 8.

In the low power mode L-MODE, while the second scan signal GCj is at the low level, when the signal at the second node N2 is in a floating state, the masking transistor MT46 is turned off. The masking transistor MT44 and the masking transistor MT45 may discharge the first output terminal OUT1 to the first voltage VGL in response to the signal at the fifth node N5 and the second scan signal GCj. Accordingly, in the low power mode L-MODE, the second scan signal GCj may be stably maintained at the low level.

In such an embodiment, the display device may drive a first display area in which a moving image is displayed and a second display area in which a still image is displayed at different frequencies. In particular, a driving frequency of the second display area in which the still image is displayed may be lowered than that of the first display area in which the moving image is displayed, and thus the power consumption may be reduced. In addition, even when a masking circuit for masking a scan signal output is included, the scan signal of a stable level may be output.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed. In addition, embodiments disclosed in the inventive concept are not intended to limit the technical spirit of the inventive concept, and the protection scope of the present invention should be interpreted based on the following appended claims and it should be appreciated that all technical spirits included within a range equivalent thereto are included in the protection scope of the present invention.

What is claimed is:

1. A scan driving circuit comprising:

a driving circuit which outputs a first node signal, a second node signal, and a second scan signal in response to clock signals and a carry signal;

a first masking circuit which outputs a first scan signal in response to a first masking signal, the first node signal and the second node signal; and a second masking circuit which discharges the first node signal to a first voltage in response to a second masking signal and the second scan signal.

2. The scan driving circuit of claim 1, wherein the driving circuit comprises:

a first transistor which delivers the carry signal as the first node signal in response to a first clock signal among the clock signals; and a second transistor which delivers a second voltage as the second scan signal in response to the first node signal.

3. The scan driving circuit of claim 2, further comprising:

a first output terminal connected to a first scan line and which outputs the first scan signal; and a second output terminal connected to a second scan line and which outputs the second scan signal.

4. The scan driving circuit of claim 3, wherein the first masking circuit comprises:

a first masking transistor connected between a second voltage terminal which receives the second voltage and a first masking node, and comprising a gate electrode which receives the second node signal;

a second masking transistor connected between the first masking node and the first output terminal, and comprising a gate electrode which receives the first masking signal; and a third masking transistor connected between the first output terminal and a first voltage terminal which receives the first voltage, and comprising a gate electrode which receives the first node signal.

5. The scan driving circuit of claim 4, wherein the driving circuit outputs a third node signal to a third node in response to the clock signals, the carry signal, and the first node signal, and the first masking circuit further comprises a fourth masking transistor and a fifth masking transistor serially connected between the first output terminal and the first voltage terminal, wherein the fourth masking transistor comprises a gate electrode connected to the third node, and the fifth masking transistor comprises a gate electrode connected to the first output terminal.

6. The scan driving circuit of claim 3, wherein the second masking circuit comprises:

a first masking transistor connected between the first transistor and a second masking node, and comprising a control electrode which receives the second masking signal; and a second masking transistor connected between the second masking node and a first voltage terminal which receives the first voltage, and comprising a gate electrode connected to the second output terminal.

7. The scan driving circuit of claim 3, wherein the first masking circuit further receives a third masking signal.

8. The scan driving circuit of claim 7, wherein the first masking circuit comprises:

a first masking transistor connected between a second voltage terminal which receives the second voltage and a first masking node, and comprising a gate electrode which receives the third masking signal;

a second masking transistor connected between a second node which delivers the second node signal and the first masking node, and comprising a control electrode which receives the first masking signal;

a third masking transistor connected between the second voltage terminal and the first output terminal, and comprising a gate electrode connected to the first masking node; and a fourth masking transistor connected between the first output terminal and a first voltage terminal which receives the first voltage, and comprising a gate electrode which receives the first node signal.

9. The scan driving circuit of claim 8, wherein the third masking signal is complementary with the first masking signal.

10. The scan driving circuit of claim 8, wherein the driving circuit outputs a third node signal to a third node in response to the clock signals, the carry signal, and the first node signal, and the first masking circuit further comprises a fourth masking transistor and a fifth masking transistor serially connected between the first output terminal and the first voltage terminal, wherein the fourth masking transistor comprises a gate electrode connected to the third node, and the fifth masking transistor comprises a gate electrode connected to the first output terminal.

11. A display device comprising:

a display panel comprising a plurality of pixels connected with a plurality of data lines, a plurality of first scan lines and a plurality of second scan lines, respectively, the display panel being divided into a first display area and a second display area;

a data driving circuit which drives the plurality of data lines;

a scan driving circuit which drives the plurality of first scan lines and the plurality of second scan lines; and a driving controller which receives an image signal and a control signal, and controls the data driving circuit and the scan driving circuit such that an image corresponding to the image signal is displayed on the display panel, wherein the driving controller outputs a first masking signal and a second masking signal which indicate a start point of the second display area, wherein the scan driving circuit comprises a plurality of driving stages, wherein each of the plurality of driving stages output a first scan signal to a corresponding first scan line among the plurality of first scan lines, and a second scan signal to a corresponding second scan line among the plurality of second scan lines, wherein the each of the plurality of driving stages comprises:

a driving circuit which outputs a first node signal, a second node signal, and the second scan signal in response to clock signals and a carry signal;

a first masking circuit which outputs the first scan signal in response to the first masking signal, the first node signal and the second node signal; and a second masking circuit which discharges the first node signal to a first voltage in response to the second masking signal and the second scan signal.

12. The display device of claim 11, wherein, in response to the first masking signal and the second masking signal, the scan driving circuit drives first scan lines and second scan lines corresponding to the first display area among the plurality of first scan lines and the plurality of second scan lines at a first driving frequency, and drives first scan lines and second scan lines corresponding to the second display area among the plurality of first scan lines and the plurality of second scan lines at a second driving frequency, and the second driving frequency is lower than the first driving frequency.

13. The display device of claim 11, wherein the second scan signal output from a j-th driving stage among the plurality of driving stages is provided as the carry signal of a (j+1)-th driving stage, where j is a natural number.

14. The display device of claim 11, wherein the driving circuit comprises:

a first transistor which delivers the carry signal as the first node signal in response to a first clock signal among the clock signals; and a second transistor which delivers a second voltage as the second scan signal in response to a first node signal.

15. The display device of claim 14, wherein the each of the plurality of driving stages further comprises:

a first output terminal connected to the first scan line and which outputs the first scan signal; and a second output terminal connected to the second scan line and which outputs the second scan signal.

16. The display device of claim 15, wherein the first masking circuit comprises:

a first masking transistor connected between a second voltage terminal which receives the second voltage and a first masking node, and comprising a gate electrode which receives the second node signal;

a second masking transistor connected between the first masking node and the first output terminal, and comprising a gate electrode which receives the first masking signal; and a third masking transistor connected between the first output terminal and a first voltage terminal which receives the first voltage, and comprising a gate electrode which receives the first node signal.

17. The display device of claim 16, wherein the driving circuit outputs a third node signal to a third node in response to the clock signals, the carry signal, and the first node signal, and the first masking circuit further comprises a fourth masking transistor and a fifth masking transistor serially connected between the first output terminal and the first voltage terminal, wherein the fourth masking transistor comprises a gate electrode connected to the third node, and the fifth masking transistor comprises a gate electrode connected to the first output terminal.

18. The display device of claim 15, wherein the second masking circuit comprises:

a first masking transistor connected between the first transistor and a second masking node, and comprising a control electrode which receives the second masking signal; and a second masking transistor connected between the second masking node and a first voltage terminal which receives the first voltage, and comprising a gate electrode connected to the second output terminal.

19. The display device of claim 15, wherein the first masking circuit comprises:

a first masking transistor connected between a second voltage terminal which receives the second voltage and a first masking node, and comprising a gate electrode which receives a third masking signal;

a second masking transistor connected between a second node which delivers the second node signal and the first masking node, and comprising a control electrode which receives the first masking signal;

a third masking transistor connected between the second voltage terminal and the first output terminal, and comprising a gate electrode connected to the first masking node; and a fourth masking transistor connected between the first output terminal and a first voltage terminal which receives the first voltage, and comprising a gate electrode which receives the first node signal.

20. The display device of claim 19, wherein the driving circuit outputs a third node signal to a third node in response to the clock signals, the carry signal, and the first node signal, and the first masking circuit further comprises a fourth masking transistor and a fifth masking transistor serially connected between the first output terminal and the first voltage terminal, wherein the fourth masking transistor comprises a gate electrode connected to the third node, and the fifth masking transistor comprises a gate electrode connected to the first output terminal.

* * * * *